US011463831B2

(12) United States Patent
Borss et al.

(10) Patent No.: US 11,463,831 B2
(45) **Date of Patent: *Oct. 4, 2022**

(54) APPARATUS AND METHOD FOR EFFICIENT OBJECT METADATA CODING

(71) Applicant: Fraunhofer-Gesellschaft zur Foerderung der angewandten Forschung e.V., Munich (DE)

(72) Inventors: Christian Borss, Erlangen (DE); Christian Ertel, Eckental (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 0 days.

This patent is subject to a terminal disclaimer.

(21) Appl. No.: 15/931,352

(22) Filed: May 13, 2020

(65) Prior Publication Data

US 2020/0275228 A1 Aug. 27, 2020

Related U.S. Application Data

(63) Continuation of application No. 15/647,892, filed on Jul. 12, 2017, now Pat. No. 10,715,943, which is a (Continued)

(30) Foreign Application Priority Data

Jul. 22, 2013 (EP) ..... 13177365
Jul. 22, 2013 (EP) ..... 13177367

(Continued)

(51) Int. Cl.
*G10L 19/008* (2013.01)
*H04S 5/00* (2006.01)

(Continued)

(52) U.S. Cl.
CPC ..... *H04S 5/005* (2013.01); *G10L 19/008* (2013.01); *H04S 3/008* (2013.01); *H04S 3/02* (2013.01);

(Continued)

(58) Field of Classification Search
CPC ..... G10L 19/008; H04S 2420/03
See application file for complete search history.

(56) References Cited

U.S. PATENT DOCUMENTS 2,605,361 A 7/1952 Cutler
7,979,282 B2 7/2011 Kim et al.

(Continued)

FOREIGN PATENT DOCUMENTS

AU 2009206856 A1 7/2009
CN 1969317 A 5/2007

(Continued)

OTHER PUBLICATIONS

Engdegard et al., Spatial Audio Object Coding (SAOC)—The Upcoming MPEG Standard on Parametric Object Based Audio Coding, convention paper 7377, Presented at the 124th Convention May 17-20, 2008 Amsterdam, The Netherlands, XP-002541458, May 2008.

(Continued)

*Primary Examiner* — Ping Lee
(74) *Attorney, Agent, or Firm* — Perkins Coie LLP; Michael A. Glenn

(57) ABSTRACT

An apparatus for generating one or more audio channels is provided. The apparatus includes a metadata decoder for receiving one or more compressed metadata signals. Each of the one or more compressed metadata signals includes a plurality of first metadata samples. The metadata decoder is configured to generate one or more reconstructed metadata signals and to generate each of the second metadata samples (Continued)

of each reconstructed metadata signal of the one or more reconstructed metadata signals depending on at least two of the first metadata samples of the reconstructed metadata signal. The apparatus includes an audio channel generator for generating the one or more audio channels depending on the one or more audio object signals and depending on the one or more reconstructed metadata signals. An apparatus for generating encoded audio information including one or more encoded audio signals and one or more compressed metadata signals is provided.

18 Claims, 16 Drawing Sheets

Related U.S. Application Data continuation of application No. 15/002,374, filed on Jan. 20, 2016, now Pat. No. 9,743,210, which is a continuation of application No. PCT/EP2014/065299, filed on Jul. 16, 2014.

(30) Foreign Application Priority Data

Jul. 22, 2013 (EP) ..... 13177378
Oct. 18, 2013 (EP) ..... 13189184

(51) Int. Cl.
*H04S 3/00* (2006.01)
*H04S 3/02* (2006.01)

(52) U.S. Cl.
CPC ..... *H04S 2400/03* (2013.01); *H04S 2400/11* (2013.01); *H04S 2420/03* (2013.01)

(56) References Cited

U.S. PATENT DOCUMENTS

| | | | |
|---|---|---|---|
| 8,255,212 | B2 | 8/2012 | Villemoes |
| 8,417,531 | B2 | 4/2013 | Kim et al. |
| 8,504,184 | B2 | 8/2013 | Ishikawa et al. |
| 8,504,377 | B2 | 8/2013 | Oh et al. |
| 8,798,776 | B2 | 8/2014 | Schildbach et al. |
| 8,824,688 | B2 | 9/2014 | Schreiner et al. |
| 9,167,346 | B2 | 10/2015 | Kraemer et al. |
| 9,530,421 | B2 | 12/2016 | Jot et al. |
| 9,788,136 | B2 | 10/2017 | Borss et al. |
| 2004/0028125 | A1 | 2/2004 | Sato |
| 2006/0083385 | A1 | 4/2006 | Allamanche et al. |
| 2006/0136229 | A1 | 6/2006 | Kjoerling et al. |
| 2006/0165184 | A1 | 7/2006 | Purnhagen et al. |
| 2007/0063877 | A1 | 3/2007 | Shmunk et al. |
| 2007/0121954 | A1 | 5/2007 | Kim et al. |
| 2007/0280485 | A1 | 12/2007 | Villemoes |
| 2008/0234845 | A1 | 9/2008 | Malvar et al. |
| 2009/0006103 | A1 | 1/2009 | Koishida et al. |
| 2009/0043591 | A1 | 2/2009 | Breebaart et al. |
| 2009/0125313 | A1 | 5/2009 | Hellmuth et al. |
| 2009/0125314 | A1 | 5/2009 | Hellmuth et al. |
| 2009/0210239 | A1 | 8/2009 | Yoon et al. |
| 2009/0271015 | A1 | 10/2009 | Oh et al. |
| 2009/0278995 | A1 | 11/2009 | Oh |
| 2009/0326958 | A1 | 12/2009 | Kim et al. |
| 2010/0014680 | A1 | 1/2010 | Oh et al. |
| 2010/0017195 | A1 | 1/2010 | Villemoes |
| 2010/0083344 | A1 | 4/2010 | Schildbach et al. |
| 2010/0094631 | A1 | 4/2010 | Engdegard et al. |
| 2010/0121647 | A1 | 5/2010 | Beack et al. |
| 2010/0135510 | A1 | 6/2010 | Yoo et al. |
| 2010/0153097 | A1 | 6/2010 | Hotho et al. |
| 2010/0153118 | A1 | 6/2010 | Hotho et al. |
| 2010/0174548 | A1 | 7/2010 | Beack et al. |
| 2010/0191354 | A1 | 7/2010 | Oh et al. |
| 2010/0202620 | A1 | 8/2010 | Oh et al. |
| 2010/0211400 | A1 | 8/2010 | Oh et al. |
| 2010/0226500 | A1 | 9/2010 | Wang et al. |
| 2010/0262420 | A1 | 10/2010 | Herre et al. |
| 2010/0310081 | A1 | 12/2010 | Lien et al. |
| 2010/0324915 | A1 | 12/2010 | Seo et al. |
| 2011/0022402 | A1 | 1/2011 | Engdegard et al. |
| 2011/0029113 | A1 | 2/2011 | Ishikawa et al. |
| 2011/0182432 | A1 | 7/2011 | Ishikawa et al. |
| 2011/0200198 | A1 | 8/2011 | Grill et al. |
| 2011/0202355 | A1 | 8/2011 | Grill et al. |
| 2011/0238425 | A1 | 9/2011 | Neuendorf et al. |
| 2011/0293025 | A1 | 12/2011 | Mudulodu et al. |
| 2011/0305344 | A1 | 12/2011 | Sole et al. |
| 2012/0002818 | A1 | 1/2012 | Heiko et al. |
| 2012/0057715 | A1 | 3/2012 | Johnston et al. |
| 2012/0062700 | A1 | 3/2012 | Antonellis et al. |
| 2012/0093213 | A1 | 4/2012 | Moriya et al. |
| 2012/0143613 | A1 | 6/2012 | Herre et al. |
| 2012/0183162 | A1 | 7/2012 | Chabanne et al. |
| 2012/0230497 | A1 | 9/2012 | Dressler et al. |
| 2012/0243690 | A1 | 9/2012 | Engdegard et al. |
| 2012/0269353 | A1 | 10/2012 | Herre et al. |
| 2012/0294449 | A1 | 11/2012 | Beack et al. |
| 2012/0308049 | A1 | 12/2012 | Schreiner et al. |
| 2012/0314875 | A1 | 12/2012 | Lee et al. |
| 2012/0323584 | A1 | 12/2012 | Koishida et al. |
| 2013/0013321 | A1 | 1/2013 | Oh et al. |
| 2013/0110523 | A1 | 5/2013 | Beack et al. |
| 2013/0132098 | A1 | 5/2013 | Beack et al. |
| 2013/0246077 | A1 | 9/2013 | Riedmiller et al. |
| 2014/0133682 | A1 | 5/2014 | Chabanne et al. |
| 2014/0133683 | A1 | 5/2014 | Robinson et al. |
| 2014/0257824 | A1 | 9/2014 | Taleb et al. |
| 2014/0350944 | A1 | 11/2014 | Jot et al. |
| 2016/0111099 | A1 | 4/2016 | Hirvonen et al. |

FOREIGN PATENT DOCUMENTS

| | | | |
|---|---|---|---|
| CN | 101151660 | A | 3/2008 |
| CN | 101288115 | A | 10/2008 |
| CN | 101529501 | A | 9/2009 |
| CN | 101542595 | A | 9/2009 |
| CN | 101542596 | A | 9/2009 |
| CN | 101542597 | A | 9/2009 |
| CN | 101553865 | A | 10/2009 |
| CN | 101617360 | A | 12/2009 |
| CN | 101632118 | A | 1/2010 |
| CN | 101689368 | A | 3/2010 |
| CN | 101743586 | A | 6/2010 |
| CN | 101809654 | A | 8/2010 |
| CN | 101821799 | A | 9/2010 |
| CN | 101849257 | A | 9/2010 |
| CN | 101884227 | A | 11/2010 |
| CN | 101926181 | A | 12/2010 |
| CN | 101930741 | A | 12/2010 |
| CN | 102016981 | A | 4/2011 |
| CN | 102016982 | A | 4/2011 |
| CN | 102099856 | A | 6/2011 |
| CN | 102124517 | A | 7/2011 |
| CN | 102171754 | A | 8/2011 |
| CN | 102171755 | A | 8/2011 |
| CN | 102239520 | A | 11/2011 |
| CN | 102387005 | A | 3/2012 |
| CN | 102388417 | A | 3/2012 |
| CN | 102449689 | A | 5/2012 |
| CN | 102576532 | A | 7/2012 |
| CN | 102640213 | A | 8/2012 |
| CN | 102768836 | A | 11/2012 |
| CN | 102883257 | A | 1/2013 |
| CN | 102892070 | A | 1/2013 |
| CN | 102931969 | A | 2/2013 |
| CN | 102100088 | B | 10/2013 |
| EP | 2137726 | A1 | 3/2008 |
| EP | 2137824 | A1 | 12/2009 |
| EP | 2194527 | A2 | 6/2010 |
| EP | 2209328 | A1 | 7/2010 |
| EP | 2479750 | A1 | 7/2012 |
| EP | 2560161 | A1 | 2/2013 |

(56) References Cited

FOREIGN PATENT DOCUMENTS

| | | | |
|---|---|---|---|
| GB | 2417866 | A | 3/2006 |
| JP | 2010521013 | A | 6/2010 |
| JP | 2010525403 | A | 7/2010 |
| JP | 2011008258 | A | 1/2011 |
| JP | 2013506164 | A | 2/2013 |
| JP | 2014525048 | A | 9/2014 |
| KR | 20080029940 | A | 4/2008 |
| KR | 20100138716 | A | 12/2010 |
| KR | 20110002489 | A | 1/2011 |
| RU | 2339088 | C1 | 11/2008 |
| RU | 2406166 | C2 | 12/2010 |
| RU | 2411594 | C2 | 2/2011 |
| RU | 2439719 | C2 | 1/2012 |
| RU | 2449387 | C2 | 4/2012 |
| RU | 2483364 | C2 | 5/2013 |
| TW | 200813981 | A | 3/2008 |
| TW | 200828269 | A | 7/2008 |
| TW | 201010450 | A | 3/2010 |
| TW | 201027517 | A | 7/2010 |
| WO | 2006048204 | A1 | 5/2006 |
| WO | 2008039042 | A1 | 4/2008 |
| WO | 2008046531 | A1 | 4/2008 |
| WO | 2008078973 | A1 | 7/2008 |
| WO | 2008111770 | A1 | 9/2008 |
| WO | 2008111773 | A1 | 9/2008 |
| WO | 2008114982 | A1 | 9/2008 |
| WO | 2008131903 | A1 | 11/2008 |
| WO | 2009049895 | A1 | 4/2009 |
| WO | 2009049896 | A1 | 4/2009 |
| WO | 2010076040 | A1 | 7/2010 |
| WO | 2010105695 | A1 | 9/2010 |
| WO | 2011020067 | A1 | 2/2011 |
| WO | 2011102967 | A1 | 8/2011 |
| WO | 2012072804 | A1 | 6/2012 |
| WO | 2012075246 | A2 | 6/2012 |
| WO | 2012125855 | A1 | 9/2012 |
| WO | 2013006325 | A1 | 1/2013 |
| WO | 2013006330 | A2 | 1/2013 |
| WO | 2013006338 | A2 | 1/2013 |
| WO | 2013024085 | A1 | 2/2013 |
| WO | 2013064957 | A1 | 5/2013 |
| WO | 2013075753 | A1 | 5/2013 |
| WO | 2013/006330 | A3 | 7/2013 |

OTHER PUBLICATIONS

"Extensible Markup Language (XML) 1.0 (Fifth Edition)", World Wide Web Consortium [online], http://www.w3.org/TR/2008/REC-XML-20081126/ (printout of internet site on Jun. 23, 2016) , Nov. 26, 2008, 35 Pages.

"Information technology—Generic Coding of Moving Pictures and Associated Audio Information" , ISO/IEC 13818-7, MPEG-2 AAC 3rd edition, ISO/IEC JTC1/SC29/WG11 N6428, Mar. 2004 , Mar. 2004 , 1-206.

"Information technology—Generic coding of moving pictures and associated audio information—Part 7: Advanced Audio Coding (AAC)", ISO/IEC 13818-7, Part 7 MPEG-2AAC, Aug. 2003 , Aug. 2003, 198 pages.

"Information technology—Generic coding of moving pictures and associated audio information—Part 7: Advanced Audio Coding (AAC)", ISO/IEC 13818-7:2004(E), Third edition , Oct. 15, 2004 , 206 pages.

"Information technology—MPEG audio technologies—Part 3: Unified speech and audio coding" , ISO/IEC FDIS 23003-3:2011 (E), , Sep. 20, 2011 , 291 pages.

"International Standard ISO/IEC 14772-1:1997—The Virtual Reality Modeling Language (VRML), Part 1: Functional specification and UTF-8 encoding", http://tecfa.unige.ch/guides/vrml/vrml97/spec/, 1997, 2 Pages.

"Synchronized Multimedia Integration Language (SMIL 3.0)", URL: http://www.w3.org/TR/2008/REC-SMIL3-20081201/, Dec. 2008, 200 Pages.

Breebaart, Jeroen, et al. , "Spatial Audio Object Coding (SAOC)—The Upcoming MPEG Standard on Parametric Object Based Audio Coding" , AES Convention 124; May 2008, AES, 60 East 42nd Street, Room 2520 New York 10165-2520, USA , pp. 1-15.

Chen, Chung Yuan, et al., "Dynamic Light Scattering of poly(vinyl alcohol)—borax aqueous solution near overlap concentration", Polymer Papers, vol. 38, No. 9., Elsevier Science Ltd., XP4058593A , 1997 , pp. 2019-2025.

Douglas, David H, et al., "Algorithms for the Reduction of the Number of Points Required to Represent a Digitized Line or its Caricature", Cartographica: The International Journal for Geographic Information and Geovisualization 10.2 , 1973 , pp. 112-122.

Engdegard, Jonas, et al., "Spatial Audio Object Coding (SAOC)—The Upcoming MPEG Standard on Parametric Object Based Audio Coding" , 124th AES Convention, Audio Engineering Society, Paper 7377 , pp. 1-15.

Geier, Matthias, et al., "Object-based Audio Reproduction and the Audio Scene Description Format", Organised Sound, vol. 15, No. 3 , pp. 219-227.

Helmrich, C.R, et al., "Efficient transform coding of two-channel audio signals by means of complex-valued stereo prediction", Acoustics, Speech and Signal Processing (ICASSP), 2011, IEEE International Conference ON, IEEE, XP032000783, DOI: 10.1109/ICASSP.2011.5946449, ISBN: 978-1-4577-0538-0 , pp. 497-500.

Herre, J., et al., "The Reference Model Architecture for MPEG Spatial Audio Coding", AES 118th Convention, Convention paper 6447, Barcelona, Spain , 13 pages.

Herre, Jurgen, et al., "From SAC to SAOC—Recent Developments in Parametric Coding of Spatial Audio", Fraunhofer Institute for Integrated Circuits, Illusions in Sound, AES 22nd UK Conference 2007, , pp. 12-1 through 12-8.

Herre, Jurgen, et al., "MPEG Spatial Audio Object Coding—The ISO/MPEG Standard for Efficient Coding of Interactive Audio Scenes", Journal of the Audio Engineering Society. vol. 60. No. 9. , 655-667.

Herre, Jurgen, et al., "MPEG Surround—the ISO/MPEG Standard for Efficient and Compatible Multi-Channel Audio Coding", AES Convention 122, Convention Paper 7084, XP040508156, New York, May 1, 2007.

Herre, Jurgen, et al., "New Concepts in Parametric Coding of Spatial Audio: From SAC to SAOC" , IEEE International Conference On Multimedia and Expo; ISBN 978-1-4244-1016-3 , pp. 1894-1897.

ISO/IEC, "MPEG audio technologies—Part 2: Spatial Audio Object Coding (SAOC)", ISO/IEC JTC1/SC29/WG11 (MPEG) International Standard 23003-2. , Oct. 1, 2010 , pp. 1-130.

ISO/IEC 14496-3, "Information technology—Coding of audio-visual objects, Part 3 Audio", Proof Reference No. ISO/IEC 14496-3:2009(E), Fourth Edition , 2009 , 1416 pp.

ISO/IEC 2300-3, "Information Technology—MPEG audio technologies—Part 3: Unified Speech and Audio Coding", International Standard, ISO/IEC FDIS 23003-3 , Nov. 23, 2011 , 286 pages.

ITU-T, "Information technology—Generic coding of moving pictures and associated audio information: Systems", Series H: Audio-visual and Multimedia Systems; ITU-T Recommendation H.222.0 , May 2012, 234 pages.

Neuendorf, Max, et al., "MPEG Unified Speech and Audio Coding—The ISO/MPEG Standard for High-Efficiency Audio Coding of all Content Types", Audio Engineering Society Convention Paper 8654, Presented at the 132nd • Convention, Apr. 26-29, 2012, , pp. 1-22.

Peters, Nils, et al., "SpatDIF: Principles, Specification, and Examples", , Jun. 28, 2013 , 6 pages.

Peters, Nils, et al., "SpatDIF: Principles, Specification, and Examples", Proceedings of the 9th Sound and Music Computing Conference, Copenhagen, Denmark , SMC2012-500 through SMC2012-505.

Peters, Nils, et al., "The Spatial Sound Description Interchange Format: Principles, Specification, and Examples", Computer Music Journal, 37:1, XP055137982, DOI: 10.1162/COMJ_a_00167, Retrieved from the Internet: URL:http://www.mitpressjournals.org/doi/pdfplus/10.1162/COMJ_a_00167 [retrieved on Sep. 3, 2014] , pp. 1-22.

(56) References Cited

OTHER PUBLICATIONS

Pulkki, Ville, "Virtual Sound Source Positioning Using Vector Base Amplitude Panning" , Journal of Audio Eng. Soc. vol. 45, No. 6. , pp. 456-466.
Ramer, Urs, "An Iterative Procedure" , Computer Graphics and Image, vol. 1 , pp. 244-256.
Schmidt, Jurgen, et al., "New and Advanced Features for Audio Presentation in the MPEG-4 Standard", 116th AES Convention, Berlin, Germany , pp. 1-13.
Sperschneider, Ralph, "Text of ISO/IEC13818-7:2004 (MPEG-2 AAC 3rd edition)", ISO/IEC JTC1/SC29/WG11 N6428, Munich, Germany, , pp. 1-198.
Sporer, Thomas, "Codierung räumlicher Audiosignale mit leichtgewichtigen Audio-Objekten", Proc. Annual Meeting of the German Audiological Society (DGA), Erlangen, Germany , 22 Pages.
Valin, Jm, et al. , "Definition of the Opus Audio Codec", IETF, Sep. 2012 , 1-326.
Wright, Matthew, et al. , "Open SoundControl: A New Protocol for Communicating with Sound Synthesizers", Proceedings of the 1997 International Computer Music Conference, vol. 2013, No. 8 , 5 pages.

(ENCODER)

(DECODER)

(ENCODER)

(DECODER)

(ENCODER)

(DECODER)

APPARATUS AND METHOD FOR EFFICIENT OBJECT METADATA CODING

CROSS-REFERENCE TO RELATED APPLICATIONS

This application is a continuation of U.S. application Ser. No. 15/647,892, filed Jul. 12, 2017, which is a continuation of U.S. application Ser. No. 15/002,374, filed Jan. 20, 2016, now U.S. Pat. No. 9,743,210, which is a continuation of International Application No. PCT/EP2014/065299, filed Jul. 16, 2014, which is incorporated herein by reference in its entirety, and additionally claims priority from European Applications Nos. EP 13177367.3, filed Jul. 22, 2013, EP 13177365.7, filed Jul. 22, 2013, EP 13177378.0, filed Jul. 22, 2013, and EP 13189284.6, filed Oct. 18, 2013, which are all incorporated herein by reference in their entirety.

BACKGROUND OF THE INVENTION

The present invention is related to audio encoding/decoding, in particular, to spatial audio coding and spatial audio object coding, and, more particularly, to an apparatus and method for efficient object metadata coding.

Spatial audio coding tools are well-known in the art and are, for example, standardized in the MPEG-surround standard. Spatial audio coding starts from original input channels such as five or seven channels which are identified by their placement in a reproduction setup, i.e., a left channel, a center channel, a right channel, a left surround channel, a right surround channel and a low frequency enhancement channel. A spatial audio encoder typically derives one or more downmix channels from the original channels and, additionally, derives parametric data relating to spatial cues such as interchannel level differences in the channel coherence values, interchannel phase differences, interchannel time differences, etc. The one or more downmix channels are transmitted together with the parametric side information indicating the spatial cues to a spatial audio decoder which decodes the downmix channel and the associated parametric data in order to finally obtain output channels which are an approximated version of the original input channels. The placement of the channels in the output setup is typically fixed and is, for example, a 5.1 format, a 7.1 format, etc.

Such channel-based audio formats are widely used for storing or transmitting multi-channel audio content where each channel relates to a specific loudspeaker at a given position. A faithful reproduction of these kind of formats necessitates a loudspeaker setup where the speakers are placed at the same positions as the speakers that were used during the production of the audio signals. While increasing the number of loudspeakers improves the reproduction of truly immersive 3D audio scenes, it becomes more and more difficult to fulfill this requirement—especially in a domestic environment like a living room.

The necessity of having a specific loudspeaker setup can be overcome by an object-based approach where the loudspeaker signals are rendered specifically for the playback setup.

For example, spatial audio object coding tools are well-known in the art and are standardized in the MPEG SAOC standard (SAOC=spatial audio object coding). In contrast to spatial audio coding starting from original channels, spatial audio object coding starts from audio objects which are not automatically dedicated for a certain rendering reproduction setup. Instead, the placement of the audio objects in the reproduction scene is flexible and can be determined by the user by inputting certain rendering information into a spatial audio object coding decoder. Alternatively or additionally, rendering information, i.e., information at which position in the reproduction setup a certain audio object is to be placed typically over time can be transmitted as additional side information or metadata. In order to obtain a certain data compression, a number of audio objects are encoded by an SAOC encoder which calculates, from the input objects, one or more transport channels by downmixing the objects in accordance with certain downmixing information. Furthermore, the SAOC encoder calculates parametric side information representing inter-object cues such as object level differences (OLD), object coherence values, etc. As in SAC (SAC=Spatial Audio Coding), the inter object parametric data is calculated for individual time/frequency tiles, i.e., for a certain frame of the audio signal comprising, for example, 1024 or 2048 samples, 24, 32, or 64, etc., frequency bands are considered so that, in the end, parametric data exists for each frame and each frequency band. As an example, when an audio piece has 20 frames and when each frame is subdivided into 32 frequency bands, then the number of time/frequency tiles is 640.

In an object-based approach, the sound field is described by discrete audio objects. This necessitates object metadata that describes among others the time-variant position of each sound source in 3D space.

A first metadata coding concept in conventional technology is the spatial sound description interchange format (SpatDIF), an audio scene description format which is still under development [1]. It is designed as an interchange format for object-based sound scenes and does not provide any compression method for object trajectories. SpatDIF uses the text-based Open Sound Control (OSC) format to structure the object metadata [2]. A simple text-based representation, however, is not an option for the compressed transmission of object trajectories.

Another metadata concept in conventional technology is the Audio Scene Description Format (ASDF) [3], a text-based solution that has the same disadvantage. The data is structured by an extension of the Synchronized Multimedia Integration Language (SMIL) which is a sub set of the Extensible Markup Language (XML) [4,5].

A further metadata concept in conventional technology is the audio binary format for scenes (AudioBIFS), a binary format that is part of the MPEG-4 specification [6,7]. It is closely related to the XML-based Virtual Reality Modeling Language (VRML) which was developed for the description of audio-visual 3D scenes and interactive virtual reality applications [8]. The complex AudioBIFS specification uses scene graphs to specify routes of object movements. A major disadvantage of AudioBIFS is that is not designed for real-time operation where a limited system delay and random access to the data stream are a requirement. Furthermore, the encoding of the object positions does not exploit the limited localization performance of human listeners. For a fixed listener position within the audio-visual scene, the object data can be quantized with a much lower number of bits [9]. Hence, the encoding of the object metadata that is applied in AudioBIFS is not efficient with regard to data compression.

It would therefore be highly appreciated, if improved, efficient object metadata coding concepts would be provided.

SUMMARY

According to an embodiment, an apparatus for generating one or more audio channels, may have: a metadata decoder for receiving one or more compressed metadata signals, wherein each of the one or more compressed metadata signals includes a plurality of first metadata samples, wherein the first metadata samples of each of the one or more compressed metadata signals indicate information associated with an audio object signal of one or more audio object signals, wherein the metadata decoder is configured to generate one or more reconstructed metadata signals, so that each reconstructed metadata signal of the one or more reconstructed metadata signals includes the first metadata samples of a compressed metadata signal of the one or more compressed metadata signals, said reconstructed metadata signal being associated with said compressed metadata signal, and further includes a plurality of second metadata samples, wherein the metadata decoder is configured to generate the second metadata samples of each of the one or more reconstructed metadata signals by generating a plurality of approximated metadata samples for said reconstructed metadata signal, wherein the metadata decoder is configured to generate each of the plurality of approximated metadata samples depending on at least two of the first metadata samples of said reconstructed metadata signal, and an audio channel generator for generating the one or more audio channels depending on the one or more audio object signals and depending on the one or more reconstructed metadata signals, wherein the metadata decoder is configured to receive a plurality of difference values for a compressed metadata signal of the one or more compressed metadata signals, and is configured to add each of the plurality of difference values to one of the approximated metadata samples of the reconstructed metadata signal being associated with said compressed metadata signal to obtain the second metadata samples of said reconstructed metadata signal.

According to another embodiment, an apparatus for generating encoded audio information including one or more encoded audio signals and one or more compressed metadata signals may have: a metadata encoder for receiving one or more original metadata signals, wherein each of the one or more original metadata signals includes a plurality of metadata samples, wherein the metadata samples of each of the one or more original metadata signals indicate information associated with an audio object signal of one or more audio object signals, wherein the metadata encoder is configured to generate the one or more compressed metadata signals, so that each compressed metadata signal of the one or more compressed metadata signals includes a first group of two or more of the metadata samples of an original metadata signal of the one or more original metadata signals, said compressed metadata signal being associated with said original metadata signal, and so that said compressed metadata signal does not include any metadata sample of a second group of another two or more of the metadata samples of said one of the original metadata signals, and an audio encoder for encoding the one or more audio object signals to obtain the one or more encoded audio signals, wherein each of the metadata samples, that is included by an original metadata signal of the one or more original metadata signals and that is also included by the compressed metadata signal, which is associated with said original metadata signal, is one of a plurality of first metadata samples, wherein each of the metadata samples, that is included by an original metadata signal of the one or more original metadata signals and that is not included by the compressed metadata signal, which is associated with said original metadata signal, is one of a plurality of second metadata samples, wherein the metadata encoder is configured to generate an approximated metadata sample for each of a plurality of the second metadata samples of one of the original metadata signals by conducting a linear interpolation depending on at least two of the first metadata samples of said one of the one or more original metadata signals, and wherein the metadata encoder is configured to generate a difference value for each second metadata sample of said plurality of the second metadata samples of said one of the one or more original metadata signals, so that said difference value indicates a difference between said second metadata sample and the approximated metadata sample of said second metadata sample.

According to another embodiment, a system may have: an inventive apparatus for generating encoded audio information including one or more encoded audio signals and one or more compressed metadata signals, and an inventive apparatus for receiving the one or more encoded audio signals and the one or more compressed metadata signals, and for generating one or more audio channels depending on the one or more encoded audio signals and depending on the one or more compressed metadata signals.

According to another embodiment, a method for generating one or more audio channels may have the steps of: receiving one or more compressed metadata signals, wherein each of the one or more compressed metadata signals includes a plurality of first metadata samples, wherein the first metadata samples of each of the one or more compressed metadata signals indicate information associated with an audio object signal of one or more audio object signals, generating one or more reconstructed metadata signals, so that each reconstructed metadata signal of the one or more reconstructed metadata signals includes the first metadata samples of a compressed metadata signal of the one or more compressed metadata signals, said reconstructed metadata signal being associated with said compressed metadata signal, and further includes a plurality of second metadata samples, wherein generating the one or more reconstructed metadata signals includes generating the second metadata samples of each of the one or more reconstructed metadata signals by generating a plurality of approximated metadata samples for said reconstructed metadata signal, wherein generating each of the plurality of approximated metadata samples is conducted depending on at least two of the first metadata samples of said reconstructed metadata signal, and generating the one or more audio channels depending on the one or more audio object signals and depending on the one or more reconstructed metadata signals, wherein the method further includes receiving a plurality of difference values for a compressed metadata signal of the one or more compressed metadata signals, and adding each of the plurality of difference values to one of the approximated metadata samples of the reconstructed metadata signal being associated with said compressed metadata signal to obtain the second metadata samples of said reconstructed metadata signal.

According to another embodiment, a method for generating encoded audio information including one or more encoded audio signals and one or more compressed metadata signals may have the steps of: receiving one or more original metadata signals, wherein each of the one or more original metadata signals includes a plurality of metadata samples, wherein the metadata samples of each of the one or more original metadata signals indicate information associated with an audio object signal of one or more audio object signals, generating the one or more compressed metadata signals, so that each compressed metadata signal of the one or more compressed metadata signals includes a first group of two or more of the metadata samples of an original metadata signal of the one or more original metadata signals, said compressed metadata signal being associated with said original metadata signal, and so that said compressed metadata signal does not include any metadata sample of a second group of another two or more of the metadata samples of said one of the original metadata signals, and encoding the one or more audio object signals to obtain the one or more encoded audio signals, wherein each of the metadata samples, that is included by an original metadata signal of the one or more original metadata signals and that is also included by the compressed metadata signal, which is associated with said original metadata signal, is one of a plurality of first metadata samples, wherein each of the metadata samples, that is included by an original metadata signal of the one or more original metadata signals and that is not included by the compressed metadata signal, which is associated with said original metadata signal, is one of a plurality of second metadata samples, wherein the method further includes generating an approximated metadata sample for each of a plurality of the second metadata samples of one of the original metadata signals by conducting a linear interpolation depending on at least two of the first metadata samples of said one of the one or more original metadata signals, and wherein the method further includes generating a difference value for each second metadata sample of said plurality of the second metadata samples of said one of the one or more original metadata signals, so that said difference value indicates a difference between said second metadata sample and the approximated metadata sample of said second metadata sample.

Another embodiment may have a non-transitory digital storage medium having computer-readable code stored thereon to perform the inventive methods when being executed on a computer or signal processor.

According to another embodiment, an apparatus for encoding audio input data to obtain audio output data may have: an input interface for receiving a plurality of audio channels, a plurality of audio objects and metadata related to one or more of the plurality of audio objects, a mixer for mixing the plurality of objects and the plurality of channels to obtain a plurality of pre-mixed channels, each pre-mixed channel including audio data of a channel and audio data of at least one object, and an inventive apparatus, wherein the audio encoder of the inventive apparatus is a core encoder for core encoding core encoder input data, and wherein the metadata encoder of the inventive apparatus is a metadata compressor for compressing the metadata related to the one or more of the plurality of audio objects.

According to another embodiment, an apparatus for decoding encoded audio data may have: an input interface for receiving the encoded audio data, the encoded audio data including a plurality of encoded channels or a plurality of encoded objects or compress metadata related to the plurality of objects, and an inventive apparatus, wherein the metadata decoder of the inventive apparatus is a metadata decompressor for decompressing the compressed metadata, wherein the audio channel generator of the inventive apparatus includes a core decoder for decoding the plurality of encoded channels and the plurality of encoded objects, wherein the audio channel generator further includes an object processor for processing the plurality of decoded objects using the decompressed metadata to obtain a number of output channels including audio data from the objects and the decoded channels, and wherein the audio channel generator further includes a post processor for converting the number of output channels into an output format.

An apparatus for generating one or more audio channels is provided. The apparatus comprises a metadata decoder for receiving one or more compressed metadata signals. Each of the one or more compressed metadata signals comprises a plurality of first metadata samples. The first metadata samples of each of the one or more compressed metadata signals indicate information associated with an audio object signal of one or more audio object signals. The metadata decoder is configured to generate one or more reconstructed metadata signals, so that each of the one or more reconstructed metadata signals comprises the first metadata samples of one of the one or more compressed metadata signals and further comprises a plurality of second metadata samples. Moreover, the metadata decoder is configured to generate each of the second metadata samples of each reconstructed metadata signal of the one or more reconstructed metadata signals depending on at least two of the first metadata samples of said reconstructed metadata signal. Moreover, the apparatus comprises an audio channel generator for generating the one or more audio channels depending on the one or more audio object signals and depending on the one or more reconstructed metadata signals.

Moreover, an apparatus for generating encoded audio information comprising one or more encoded audio signals and one or more compressed metadata signals is provided. The apparatus comprises a metadata encoder for receiving one or more original metadata signals. Each of the one or more original metadata signals comprises a plurality of metadata samples. The metadata samples of each of the one or more original metadata signals indicate information associated with an audio object signal of one or more audio object signals. The metadata encoder is configured to generate the one or more compressed metadata signals, so that each compressed metadata signal of the one or more compressed metadata signals comprises a first group of two or more of the metadata samples of one of the original metadata signals, and so that said compressed metadata signal does not comprise any metadata sample of a second group of another two or more of the metadata samples of said one of the original metadata signals. Moreover, the apparatus comprises an audio encoder for encoding the one or more audio object signals to obtain the one or more encoded audio signals.

Furthermore, a system is provided. The system comprises an apparatus for generating encoded audio information comprising one or more encoded audio signals and one or more compressed metadata signals as described above. Moreover, the system comprises an apparatus for receiving the one or more encoded audio signals and the one or more compressed metadata signals, and for generating one or more audio channels depending on the one or more encoded audio signals and depending on the one or more compressed metadata signals as described above.

According to embodiments, data compression concepts for object metadata are provided, which achieve efficient compression mechanism for transmission channels with limited data rate. Moreover, a good compression rate for pure azimuth changes, for example, camera rotations, is achieved. Furthermore, the provided concepts support discontinuous trajectories, e.g., positional jumps. Moreover, low decoding complexity is realized. Furthermore, random access with limited reinitialization time is achieved.

Moreover, a method for generating one or more audio channels is provided. The method comprises:

Receiving one or more compressed metadata signals, wherein each of the one or more compressed metadata signals comprises a plurality of first metadata samples, wherein the first metadata samples of each of the one or more compressed metadata signals indicate information associated with an audio object signal of one or more audio object signals.

Generating one or more reconstructed metadata signals, so that each of the one or more reconstructed metadata signals comprises the first metadata samples of one of the one or more compressed metadata signals and further comprises a plurality of second metadata samples, wherein generating one or more reconstructed metadata signals comprises the step of generating each of the second metadata samples of each reconstructed metadata signal of the one or more reconstructed metadata signals depending on at least two of the first metadata samples of said reconstructed metadata signal. And:

Generating the one or more audio channels depending on the one or more audio object signals and depending on the one or more reconstructed metadata signals.

Furthermore, a method for generating encoded audio information comprising one or more encoded audio signals and one or more compressed metadata signals is provided. The method comprises:

Receiving one or more original metadata signals, wherein each of the one or more original metadata signals comprises a plurality of metadata samples, wherein the metadata samples of each of the one or more original metadata signals indicate information associated with an audio object signal of one or more audio object signals.

Generating the one or more compressed metadata signals, so that each compressed metadata signal of the one or more compressed metadata signals comprises a first group of two or more of the metadata samples of one of the original metadata signals, and so that said compressed metadata signal does not comprise any metadata sample of a second group of another two or more of the metadata samples of said one of the original metadata signals. And:

Encoding the one or more audio object signals to obtain the one or more encoded audio signals.

Moreover, a computer program for implementing the above-described method when being executed on a computer or signal processor is provided.

BRIEF DESCRIPTION OF THE DRAWINGS

Embodiments of the present invention will be detailed subsequently referring to the appended drawings, in which.

DETAILED DESCRIPTION OF THE INVENTION

Figure 2:
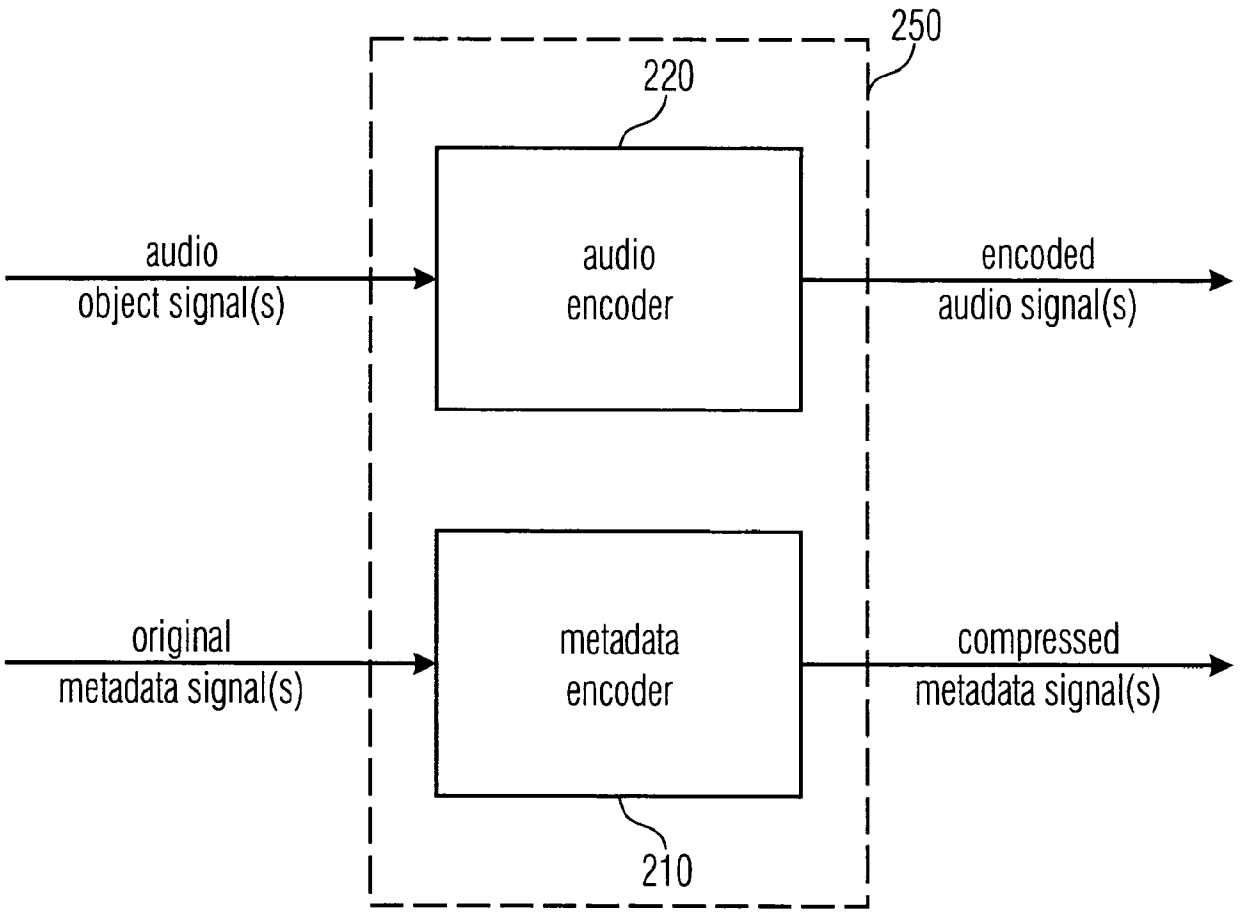
FIG. 2 illustrates an apparatus for generating encoded audio information comprising one or more encoded audio signals and one or more compressed metadata signals according to an embodiment.

FIG. 2 illustrates an apparatus 250 for generating encoded audio information comprising one or more encoded audio signals and one or more compressed metadata signals according to an embodiment.

The apparatus 250 comprises a metadata encoder 210 for receiving one or more original metadata signals. Each of the one or more original metadata signals comprises a plurality of metadata samples. The metadata samples of each of the one or more original metadata signals indicate information associated with an audio object signal of one or more audio object signals. The metadata encoder 210 is configured to generate the one or more compressed metadata signals, so that each compressed metadata signal of the one or more compressed metadata signals comprises a first group of two or more of the metadata samples of one of the original metadata signals, and so that said compressed metadata signal does not comprise any metadata sample of a second group of another two or more of the metadata samples of said one of the original metadata signals.

Moreover, the apparatus 250 comprises an audio encoder 220 for encoding the one or more audio object signals to obtain the one or more encoded audio signals. For example, the audio channel generator may comprise an SAOC encoder according to the state of the art to encode the one or more audio object signals to obtain one or more SAOC transport channels as the one or more encoded audio signals. Various other encoding techniques to encode one or more audio object channels may alternatively or additionally be employed to encode the one or more audio object channels.

Figure 1:
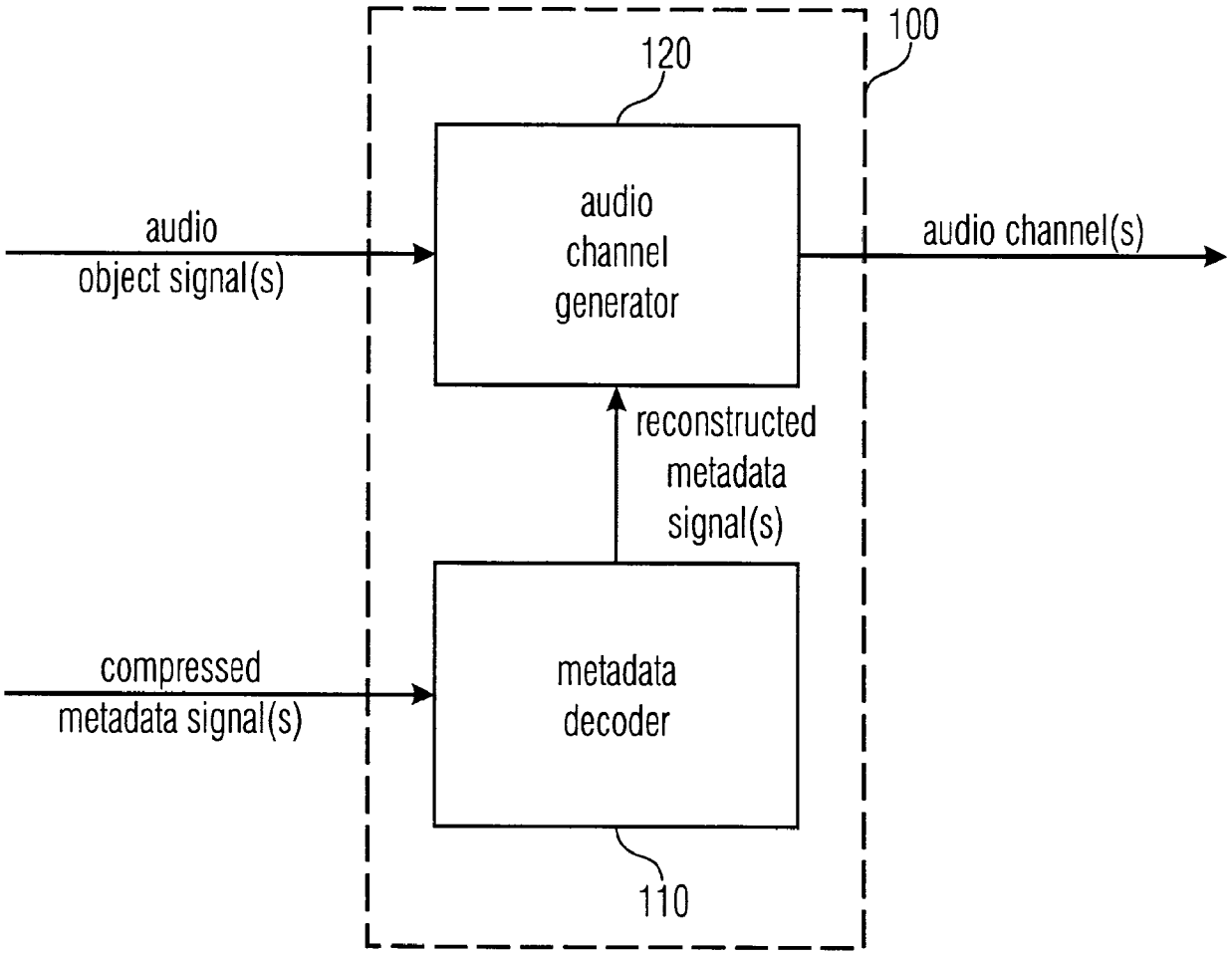
FIG. 1 illustrates an apparatus for generating one or more audio channels according to an embodiment.

FIG. 1 illustrates an apparatus 100 for generating one or more audio channels according to an embodiment.

The apparatus 100 comprises a metadata decoder 110 for receiving one or more compressed metadata signals. Each of the one or more compressed metadata signals comprises a plurality of first metadata samples. The first metadata samples of each of the one or more compressed metadata signals indicate information associated with an audio object signal of one or more audio object signals. The metadata decoder 110 is configured to generate one or more reconstructed metadata signals, so that each of the one or more reconstructed metadata signals comprises the first metadata samples of one of the one or more compressed metadata signals and further comprises a plurality of second metadata samples. Moreover, the metadata decoder 110 is configured to generate each of the second metadata samples of each reconstructed metadata signal of the one or more reconstructed metadata signals depending on at least two of the first metadata samples of said reconstructed metadata signal.

Moreover, the apparatus 100 comprises an audio channel generator 120 for generating the one or more audio channels depending on the one or more audio object signals and depending on the one or more reconstructed metadata signals.

When referring to metadata samples, it should be noted, that a metadata sample is characterised by its metadata sample value, but also by the instant of time, to which it relates. For example, such an instant of time may be relative to the start of an audio sequence or similar. For example, an index n or k might identify a position of the metadata sample in a metadata signal and by this, a (relative) instant of time (being relative to a start time) is indicated. It should be noted that when two metadata samples relate to different instants of time, these two metadata samples are different metadata samples, even when their metadata sample values are equal, what sometimes may be the case.

The above embodiments are based on the finding that metadata information (comprised by a metadata signal) that is associated with an audio object signal often changes slowly.

For example, a metadata signal may indicate position information on an audio object (e.g., an azimuth angle, an elevation angle or a radius defining the position of an audio object). It may be assumed that, at most times, the position of the audio object either does not change or only changes slowly.

Or, a metadata signal may, for example, indicate a volume (e.g., a gain) of an audio object, and it may also be assumed, that at most times, the volume of an audio object changes slowly.

For this reason, it is not necessitated to transmit the (complete) metadata information at every instant of time. Instead, the (complete) metadata information is only transmitted at certain instants of time, for example, periodically, e.g., at every N-th instant of time, e.g., at point in time 0, N, 2N, 3N, etc. At the decoder side, for the intermediate points in time (e.g., points in time 1, 2, . . . , N−1) the metadata can then be approximated based on the metadata samples for two or more points in time. For example, the metadata samples for points in time 1, 2, . . . , N−1 can be approximated at the decoder side depending on the metadata samples for points in time 0 and N, e.g., by employing linear interpolation. As stated before, such an approach is based on the finding that metadata information on audio objects in general changes slowly.

For example, in embodiments, three metadata signals specify the position of an audio object in a 3D space. A first one of the metadata signals may, e.g., specify the azimuth angle of the position of the audio object. A second one of the metadata signals may, e.g., specify the elevation angle of the position of the audio object. A third one of the metadata signals may, e.g., specify the radius relating to the distance of the audio object.

Azimuth angle, elevation angle and radius unambiguously define the position of an audio object in a 3D space from an origin. This is illustrated with reference to FIG. 4.

Figure 4:
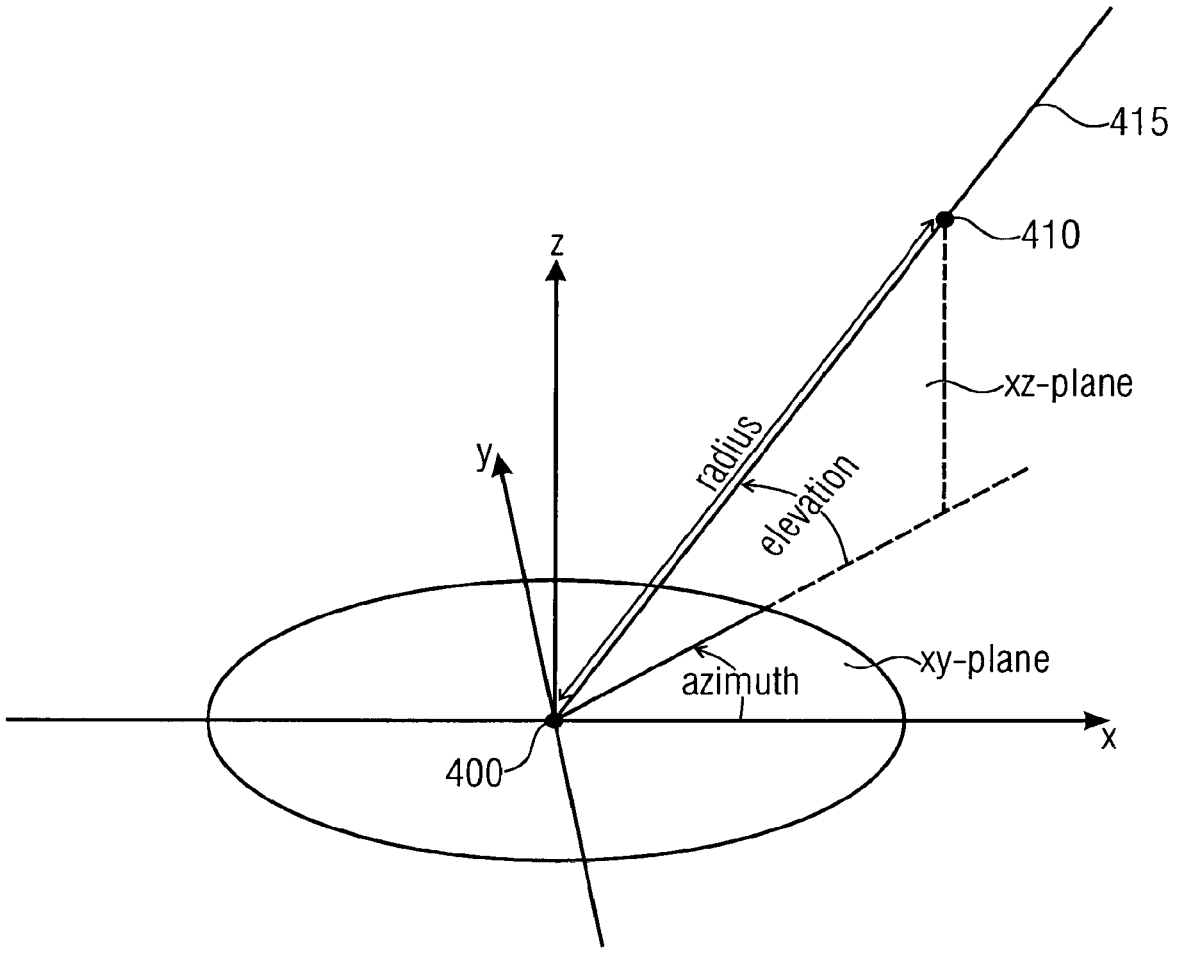
FIG. 4 illustrates the position of an audio object in a three-dimensional space from an origin expressed by azimuth, elevation and radius.

FIG. 4 illustrates the position 410 of an audio object in a three-dimensional (3D) space from an origin 400 expressed by azimuth, elevation and radius.

The elevation angle specifies, for example, the angle between the straight line from the origin to the object position and the normal projection of this straight line onto the xy-plane (the plane defined by the x-axis and the y-axis). The azimuth angle defines, for example, the angle between the x-axis and the said normal projection. By specifying the azimuth angle and the elevation angle, the straight line 415 through the origin 400 and the position 410 of the audio object can be defined. By furthermore specifying the radius, the exact position 410 of the audio object can be defined.

In an embodiment, the azimuth angle is defined for the range: $-180° < \text{azimuth} \leq 180°$, the elevation angle is defined for the range: $-90° \leq \text{elevation} \leq 90°$ and the radius may, for example, be defined in meters [m] (greater than or equal to 0 m).

In another embodiment, where it, may, for example, be assumed that all x-values of the audio object positions in an xyz-coordinate system are greater than or equal to zero, the azimuth angle may be defined for the range: $-90° \leq \text{azimuth} \leq 90°$, the elevation angle may be defined for the range: $-90° \leq \text{elevation} \leq 90°$, and the radius may, for example, be defined in meters [m].

In a further embodiment, the metadata signals may be scaled such that the azimuth angle is defined for the range: $-128° < \text{azimuth} \leq 128°$, the elevation angle is defined for the range: $-32° \leq \text{elevation} \leq 32°$ and the radius may, for example, be defined on a logarithmic scale. In some embodiments, the original metadata signals, the compressed metadata signals and the reconstructed metadata signals, respectively, may comprise a scaled representation of a position information and/or a scaled representation of a volume of one of the one or more audio object signals.

The audio channel generator 120 may, for example, be configured to generate the one or more audio channels depending on the one or more audio object signals and depending on the reconstructed metadata signals, wherein the reconstructed metadata signals may, for example, indicate the position of the audio objects.

Figure 5:
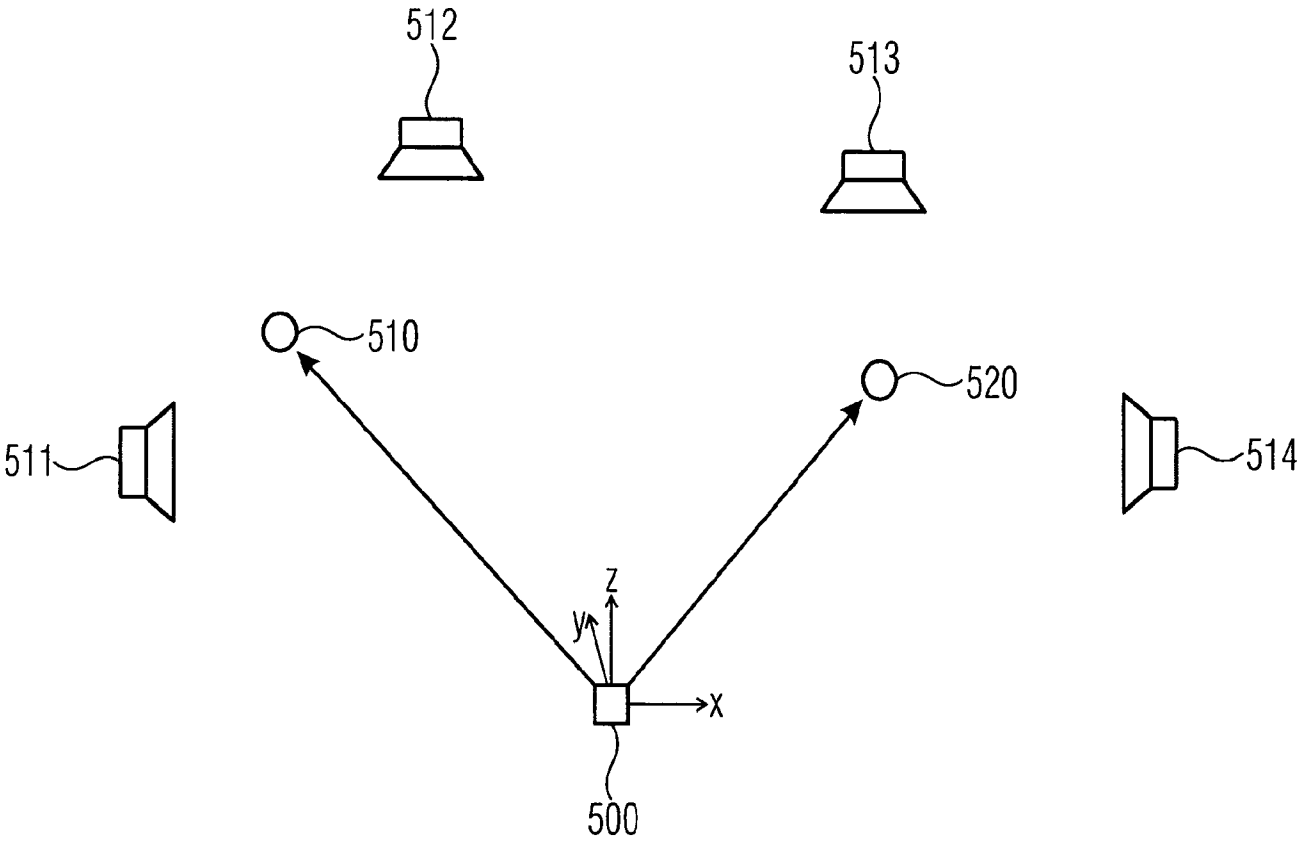
FIG. 5 illustrates positions of audio objects and a loudspeaker setup assumed by the audio channel generator.

FIG. 5 illustrates positions of audio objects and a loudspeaker setup assumed by the audio channel generator. The origin 500 of the xyz-coordinate system is illustrated. Moreover, the position 510 of a first audio object and the position 520 of a second audio object is illustrated. Furthermore, FIG. 5 illustrates a scenario, where the audio channel generator 120 generates four audio channels for four loudspeakers. The audio channel generator 120 assumes that the four loudspeakers 511, 512, 513 and 514 are located at the positions shown in FIG. 5.

In FIG. 5, the first audio object is located at a position 510 close to the assumed positions of loudspeakers 511 and 512, and is located far away from loudspeakers 513 and 514. Therefore, the audio channel generator 120 may generate the four audio channels such that the first audio object 510 is reproduced by loudspeakers 511 and 512 but not by loudspeakers 513 and 514.

In other embodiments, audio channel generator 120 may generate the four audio channels such that the first audio object 510 is reproduced with a high volume by loudspeakers 511 and 512 and with a low volume by loudspeakers 513 and 514.

Moreover, the second audio object is located at a position 520 close to the assumed positions of loudspeakers 513 and 514, and is located far away from loudspeakers 511 and 512. Therefore, the audio channel generator 120 may generate the four audio channels such that the second audio object 520 is reproduced by loudspeakers 513 and 514 but not by loudspeakers 511 and 512.

In other embodiments, audio channel generator 120 may generate the four audio channels such that the second audio object 520 is reproduced with a high volume by loudspeakers 513 and 514 and with a low volume by loudspeakers 511 and 512.

In alternative embodiments, only two metadata signals are used to specify the position of an audio object. For example, only the azimuth and the radius may be specified, for example, when it is assumed that all audio objects are located within a single plane.

In further other embodiments, for each audio object, only a single metadata signal is encoded and transmitted as position information. For example, only an azimuth angle may be specified as position information for an audio object (e.g., it may be assumed that all audio objects are located in the same plane having the same distance from a center point, and are thus assumed to have the same radius). The azimuth information may, for example, be sufficient to determine that an audio object is located close to a left loudspeaker and far away from a right loudspeaker. In such a situation, the audio channel generator 120 may, for example, generate the one or more audio channels such that the audio object is reproduced by the left loudspeaker, but not by the right loudspeaker.

For example, Vector Base Amplitude Panning (VBAP) may be employed (see, e.g., [12]) to determine the weight of an audio object signal within each of the audio channels of the loudspeakers. E.g., with respect to VBAP, it is assumed that an audio object relates to a virtual source.

In embodiments, a further metadata signal may specify a volume, e.g., a gain (for example, expressed in decibel [dB]) for each audio object.

For example, in FIG. 5, a first gain value may be specified by a further metadata signal for the first audio object located at position 510 which is higher than a second gain value being specified by another further metadata signal for the second audio object located at position 520. In such a situation, the loudspeakers 511 and 512 may reproduce the first audio object with a volume being higher than the volume with which loudspeakers 513 and 514 reproduce the second audio object.

Embodiments also assume that such gain values of audio objects often change slowly. Therefore, it is not necessitated to transmit such metadata information at every point in time. Instead, metadata information is only transmitted at certain points in time. At intermediate points in time, the metadata information may, e.g., be approximated using the preceding metadata sample and the succeeding metadata sample, that were transmitted. For example, linear interpolation may be employed for approximation of intermediate values. E.g., the gain, the azimuth, the elevation and/or the radius of each of the audio objects may be approximated for points in time, where such metadata was not transmitted.

By such an approach, considerable savings in the transmission rate of metadata can be achieved.

Figure 3:
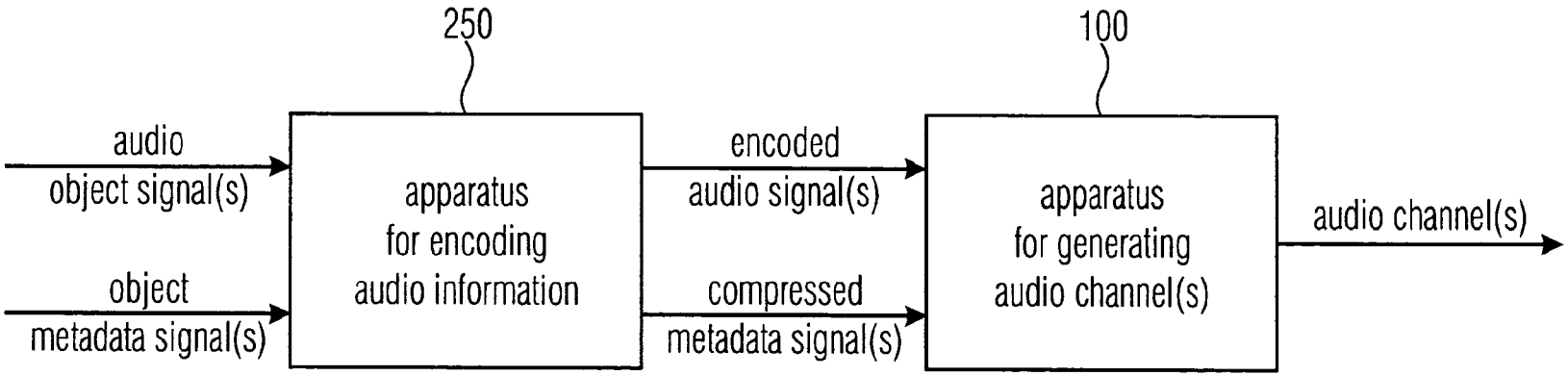
FIG. 3 illustrates a system according to an embodiment.

FIG. 3 illustrates a system according to an embodiment.

The system comprises an apparatus 250 for generating encoded audio information comprising one or more encoded audio signals and one or more compressed metadata signals as described above.

Moreover, the system comprises an apparatus 100 for receiving the one or more encoded audio signals and the one or more compressed metadata signals, and for generating one or more audio channels depending on the one or more encoded audio signals and depending on the one or more compressed metadata signals as described above.

For example, the one or more encoded audio signals may be decoded by the apparatus 100 for generating one or more audio channels by employing a SAOC decoder according to the state of the art to obtain one or more audio object signals, when the apparatus 250 for encoding did use a SAOC encoder for encoding the one or more audio objects.

Considering object positions only as an example for metadata, to allow random access with limited reinitialization time, embodiments provide a full retransmission of all object positions on a regular basis.

According to an embodiment, the apparatus 100 is configured to receive random access information, wherein, for each compressed metadata signal of the one or more compressed metadata signals, the random access information indicates an accessed signal portion of said compressed metadata signal, wherein at least one other signal portion of said metadata signal is not indicated by said random access information, and wherein the metadata decoder 110 is configured to generate one of the one or more reconstructed metadata signals depending on the first metadata samples of said accessed signal portion of said compressed metadata signal, but not depending on any other first metadata samples of any other signal portion of said compressed metadata signal. In other words, by specifying random access information, a portion of each of the compressed metadata signals can be specified, wherein the other portions of said metadata signal are not specified. In this case, only the specified portion of said compressed metadata signal is reconstructed as one of the reconstructed metadata signals, but not the other portions. Reconstruction is possible, as the transmitted first metadata samples of said compressed metadata signal represent the complete metadata information of said compressed metadata signal for certain points-in-time (for other points-in-time, however, the metadata information is not transmitted).

Figure 6:
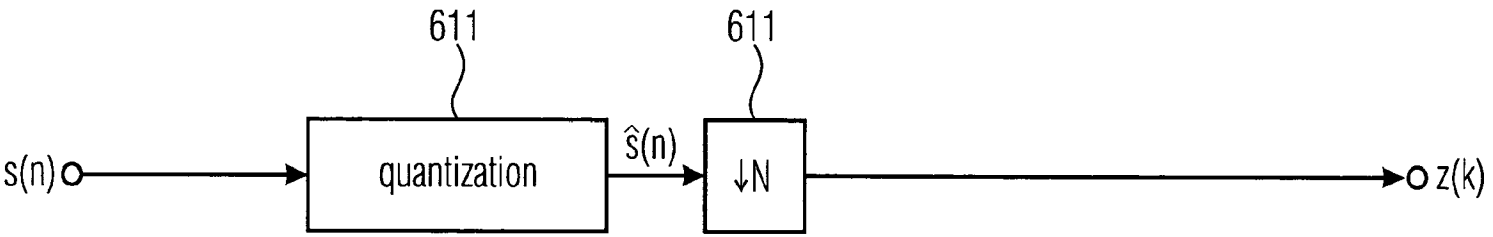
FIG. 6 illustrates a metadata encoding according to an embodiment.

FIG. 6 illustrates a metadata encoding according to an embodiment. A metadata encoder 210 according to embodiments may be configured to implement the metadata encoding illustrated by FIG. 6.

In FIG. 6, s(n) may represent one of the original metadata signals. For example, s(n) may, e.g., represent a function of an azimuth angle of one of the audio objects, and n may indicate time (e.g., by indicating sample positions in the original metadata signal).

The time-variant trajectory component s(n), which is sampled at a sampling rate that is significantly lower (for example, 1:1024 or lower) than the audio sampling rate, is quantized (see 611) and down-sampled (see 612) by a factor of N. This results in the afore mentioned regularly transmitted digital signal which we denote as z(k).

z(k) is one of the one or more compressed metadata signals. For example, every N-th metadata sample of $\hat{s}(n)$ is also a metadata sample of the compressed metadata signal z(k), while the other N−1 metadata samples of $\hat{s}(n)$ between every N-th metadata sample are not metadata samples of the compressed metadata signal z(k).

For example, assume that in s(n), n indicates time (e.g., by indicating sample positions in the original metadata signal), where n is a positive integer number or 0. (e.g., start time: n=0). N is the downsampling factor. For example, N=32 or any other suitable downsampling factor.

E.g., downsampling in 612 to obtain the compressed metadata signal z from the original metadata signal s may, for example, be realized, such that:

$$z(k)=\hat{s}(k\cdot N);\ \text{wherein } k \text{ is a positive integer number or } 0\ (k=0,1,2,\ldots)$$

Thus:

$$z(0)=\hat{s}(0);\ z(1)=\hat{s}(32);\ z(2)=\hat{s}(64);\ z(3)=\hat{s}(96),\ldots$$

Figure 7:
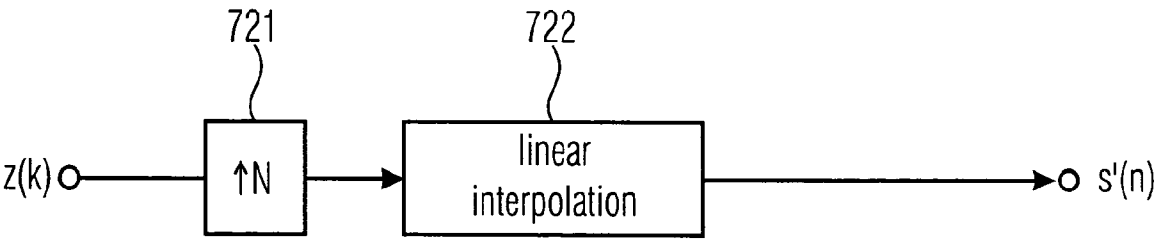
FIG. 7 illustrates a metadata decoding according to an embodiment.

FIG. 7 illustrates a metadata decoding according to an embodiment. A metadata decoder 110 according to embodiments may be configured to implement the metadata decoding illustrated by FIG. 7.

According to the embodiment illustrated by FIG. 7, the metadata decoder 110 is configured to generate each reconstructed metadata signal of the one or more reconstructed metadata signals by upsampling one of the one or more compressed metadata signals, wherein the metadata decoder 110 is configured to generate each of the second metadata samples of each reconstructed metadata signal of the one or more reconstructed metadata signals by conducting a linear interpolation depending on at least two of the first metadata samples of said reconstructed metadata signal.

Thus, each reconstructed metadata signal comprises all metadata samples of its compressed metadata signal (these samples are referred to as "first metadata samples" of the one or more compressed metadata signals).

By conducting upsampling, additional ("second") metadata samples are added to the reconstructed metadata signal. The step of upsampling determines, at which positions in the reconstructed metadata signal (e.g., at which "relative" time instants) the additional (second) metadata samples are added to the metadata signal.

By conducting linear interpolation, the metadata sample values of the second metadata samples are determined. The linear interpolation is conducted based on two metadata samples of the compressed metadata signal (which have become first metadata samples of the reconstructed metadata signal).

According to embodiments, upsampling and generating the second metadata samples by conducting linear interpolation may, e.g., be conducted in a single step.

In FIG. 7, the inverse up-sampling process (see 721) in combination with a linear interpolation (see 722) results in a coarse approximation of the original signal. The inverse up-sampling process (see 721) and the linear interpolation (see 722), may, e.g., be conducted in a single step.

E.g., upsampling (721) and linear interpolation (722) on the decoder side may, for example, be conducted, such that:

$$s'(k\cdot N)=z(k);\ \text{wherein } k \text{ is a positive integer or } 0$$

$$s'(k\cdot N+j)=z(k-1)+\frac{j}{N}[z(k)-z(k-1)];$$

wherein j is an integer with $1\leq j\leq N-1$

Here, z(k) is the actually received metadata sample of the compressed metadata signal z, and z(k−1) is the metadata sample of the compressed metadata signal z, that was received immediately before the actually received metadata sample z(k).

Figure 8:
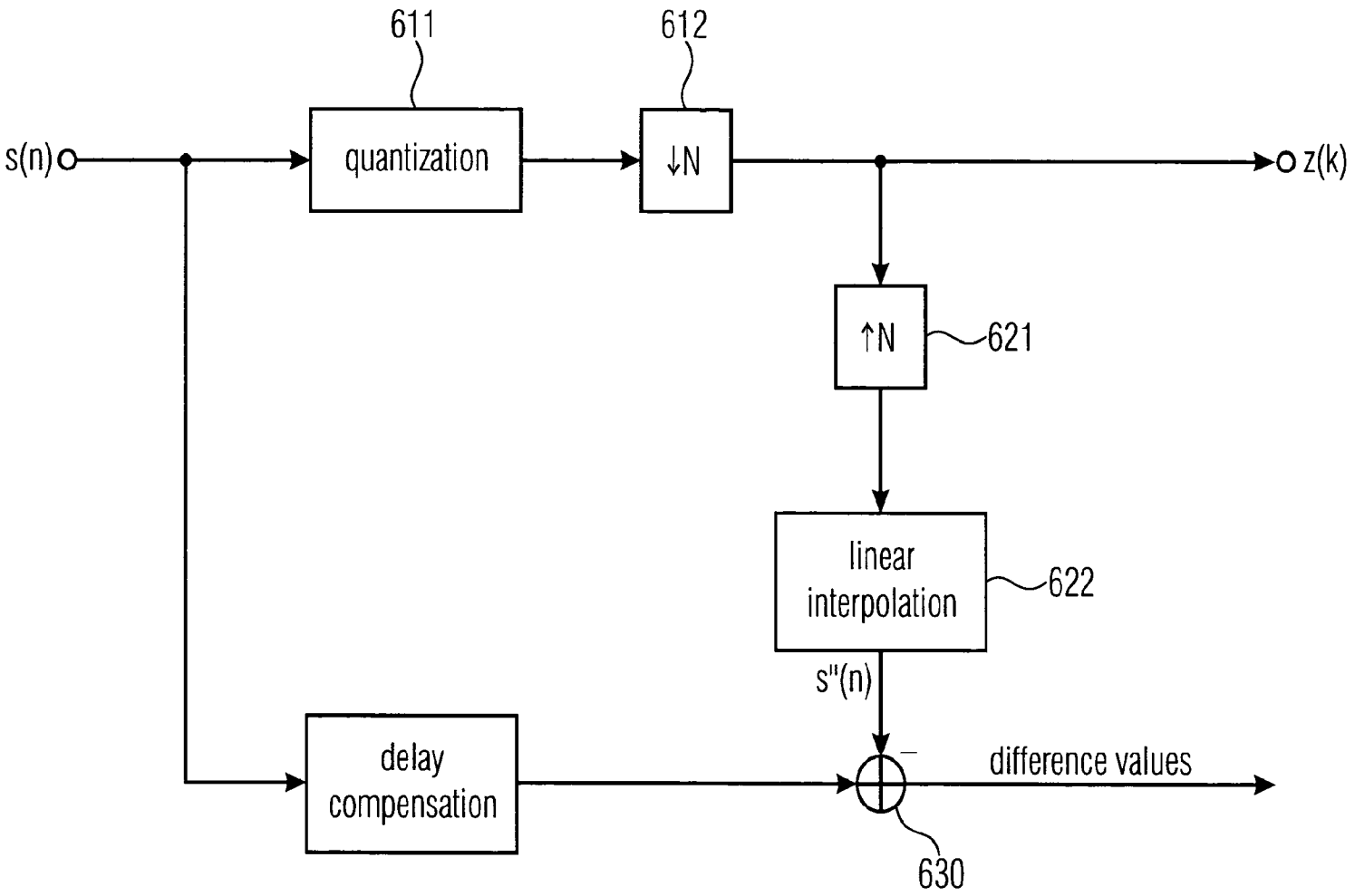
FIG. 8 illustrates a metadata encoding according to another embodiment.

FIG. 8 illustrates a metadata encoding according to another embodiment. A metadata encoder 210 according to embodiments may be configured to implement the metadata encoding illustrated by FIG. 8.

In embodiments, e.g., as illustrated by FIG. 8, in the metadata encoding, the fine structure may be specified by the encoded difference between the delay compensated input signal and the linearly interpolated coarse approximation.

According to such embodiments, the inverse up-sampling process in combination with the linear interpolation is also conducted as part of the metadata encoding on the encoder side (see 621 and 622 in FIG. 6). Again, inverse up-sampling process (see 621) and the linear interpolation (see 622), may, e.g., be conducted in a single step.

As already described above, the metadata encoder 210 is configured to generate the one or more compressed metadata signals, so that each compressed metadata signal of the one or more compressed metadata signals comprises a first group of two or more of the metadata samples of an original metadata signal of the one or more original metadata signals. Said compressed metadata signal can be considered as being associated with said original metadata signal.

Each of the metadata samples that is comprised by an original metadata signal of the one or more original metadata signals and that is also comprised by the compressed metadata signal, which is associated with said original metadata signal, can be considered as one of a plurality of first metadata samples.

Moreover, each of the metadata samples that is comprised by an original metadata signal of the one or more original metadata signals and that is not comprised by the compressed metadata signal, which is associated with said original metadata signal, is one of a plurality of second metadata samples.

According to the embodiment of FIG. 8, the metadata encoder 210 is configured to generate an approximated metadata sample for each of a plurality of the second metadata samples of one of the original metadata signals by conducting a linear interpolation depending on at least two of the first metadata samples of said one of the one or more original metadata signals.

Furthermore, in the embodiment of FIG. 8, the metadata encoder 210 is configured to generate a difference value for each second metadata sample of said plurality of the second metadata samples of said one of the one or more original metadata signals, so that said difference value indicates a difference between said second metadata sample and the approximated metadata sample of said second metadata sample.

In an embodiment, that is described later on with reference to FIG. 10, the metadata encoder 210 may, for example, be configured to determine for at least one of the difference values of said plurality of the second metadata samples of said one of the one or more original metadata signals, whether each of the at least one of said difference values is greater than a threshold value.

In embodiments according to FIG. 8, the approximated metadata samples may, for example, be determined (e.g., as samples s"(n) of a signal s") by conducting upsampling on the compressed metadata signal z(k) and by conducting linear interpolation. Upsampling and linear interpolation may, for example, be conducted as part of the metadata encoding on the encoder side (see 621 and 622 in FIG. 6), e.g., in the same way, as described for the metadata decoding with reference to 721 and 722:

$$s''(k\cdot N)=z(k);\ \text{wherein } k \text{ is a positive integer or } 0$$

$$s''(k\cdot N+j)=z(k-1)+\frac{j}{N}[z(k)-z(k-1)];$$

wherein j is an integer with $1\leq j\leq N-1$

For example, in the embodiment illustrated by FIG. 8, when conducting metadata encoding, difference values may be determined in 630 for the differences $$s(n)-s''(n),\ \text{e.g., for all } n \text{ with } (k-1)\cdot N<n<k\cdot N,\ \text{or}$$

$$\text{e.g., for all } n \text{ with } (k-1)\cdot N<n\leq k\cdot N$$

In embodiments, one or more of these difference values are transmitted to the metadata decoder.

Figure 9:
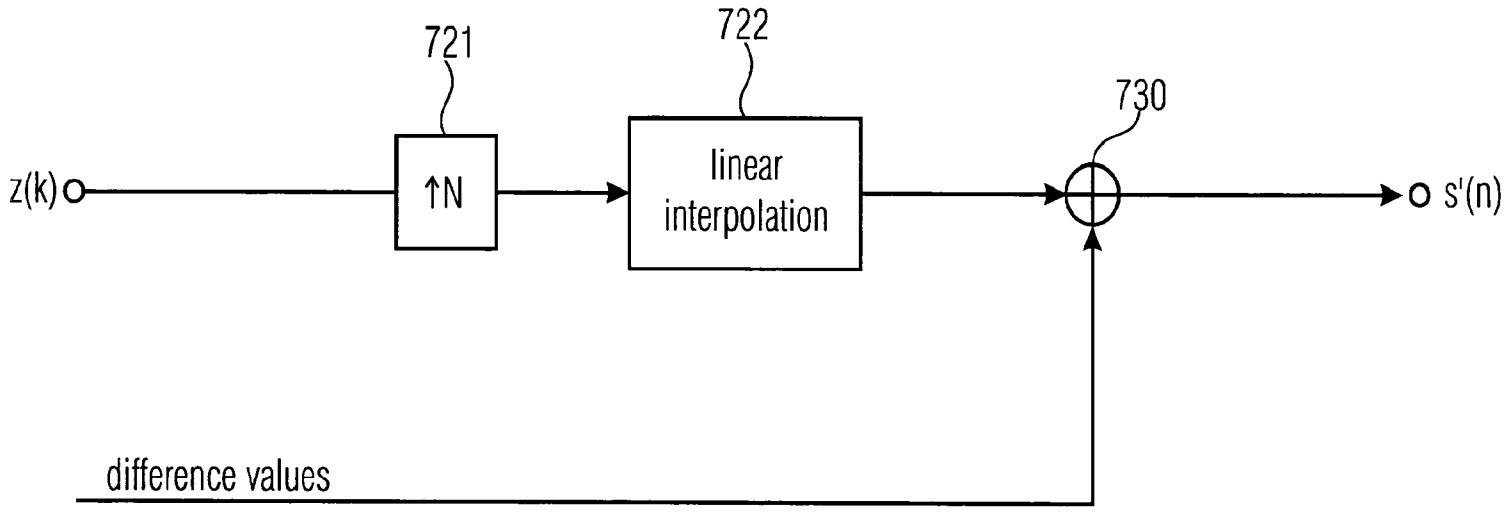
FIG. 9 illustrates a metadata decoding according to another embodiment.

FIG. 9 illustrates a metadata decoding according to another embodiment. A metadata decoder 110 according to embodiments may be configured to implement the metadata decoding illustrated by FIG. 9.

As already described above, each reconstructed metadata signal of the one or more reconstructed metadata signals comprises the first metadata samples of a compressed metadata signal of the one or more compressed metadata signals. Said reconstructed metadata signal is considered to be associated with said compressed metadata signal.

In embodiments illustrated by FIG. 9, the metadata decoder 110 is configured to generate the second metadata samples of each of the one or more reconstructed metadata signals by generating a plurality of approximated metadata samples for said reconstructed metadata signal, wherein the metadata decoder 110 is configured to generate each of the plurality of approximated metadata samples depending on at least two of the first metadata samples of said reconstructed metadata signal. For example, these approximated metadata samples may be generated by linear interpolation as described with reference to FIG. 7.

According to the embodiment illustrated by FIG. 9, the metadata decoder 110 is configured to receive a plurality of difference values for a compressed metadata signal of the one or more compressed metadata signals. The metadata decoder 110 is furthermore configured to add each of the plurality of difference values to one of the approximated metadata samples of the reconstructed metadata signal being associated with said compressed metadata signal to obtain the second metadata samples of said reconstructed metadata signal.

For all those approximated metadata samples, for which a difference value has been received, that difference value is added to the approximated metadata sample to obtain the second metadata samples.

According to an embodiment, an approximated metadata sample, for which no difference value has been received, is used as a second metadata sample of the reconstructed metadata signal.

According to a different embodiment, however, if no difference value is received for an approximated metadata sample, an approximated difference value is generated for said approximated metadata sample depending on one or more of the received difference values, and said approximated metadata sample is added to said approximated metadata sample, see below.

According to the embodiment illustrated by FIG. 9 received difference values are added (see 730) to the corresponding metadata samples of the upsampled metadata signal. By this, the corresponding interpolated metadata samples, for which difference values have been transmitted, can be corrected, if necessitated, to obtain the correct metadata samples.

Returning to the metadata encoding in FIG. 8, in embodiments, fewer bits are used for encoding the difference values than the number of bits used for encoding the metadata samples. These embodiments are based on the finding that (e.g., N) subsequent metadata samples in most times only vary slightly. For example, if one kind of metadata samples is encoded, e.g., by 8 bits, these metadata samples can take on one out of 256 different values. Because of the, in general, slight changes of (e.g., N) subsequent metadata values, it may be considered sufficient, to encode the difference values only, e.g., by 5 bits. Thus, even if difference values are transmitted, the number of transmitted bits can be reduced.

In an embodiment, one or more difference values are transmitted, each of the one or more difference values is encoded with fewer bits than each of the metadata samples, and each of the difference value is an integer value.

According to an embodiment, the metadata encoder 110 is configured to encode one or more of the metadata samples of one of the one or more compressed metadata signals with a first number of bits, wherein each of said one or more of the metadata samples of said one of the one or more compressed metadata signals indicates an integer. Moreover metadata encoder (110) is configured to encode one or more of the difference values with a second number of bits, wherein each of said one or more of the difference values indicates an integer, wherein the second number of bits is smaller than the first number of bits.

Consider, for example, that in an embodiment, metadata samples may represent an azimuth being encoded by 8 bits. E.g., the azimuth may be an integer between $-90 \leq$azimuth$\leq 90$. Thus, the azimuth can take on 181 different values. If however, one can assume that (e.g. N) subsequent azimuth samples only differ by no more than, e.g., ±15, then, 5 bits ($2^5=32$) may be enough to encode the difference values. If difference values are represented as integers, then determining the difference values automatically transforms the additional values, to be transmitted, to a suitable value range.

For example, consider a case where a first azimuth value of a first audio object is 60° and its subsequent values vary from 45° to 75°. Moreover, consider that a second azimuth value of a second audio object is −30° and its subsequent values vary from −45° to −15°. By determining difference values for both the subsequent values of the first audio object and for both the subsequent values of the second audio object, the difference values of the first azimuth value and of the second azimuth value are both in the value range from −15° to +15°, so that 5 bits are sufficient to encode each of the difference values and so that the bit sequence, which encodes the difference values, has the same meaning for difference values of the first azimuth angle and difference values of the second azimuth value.

In an embodiment, each difference value, for which no metadata sample exists in the compressed metadata signal, is transmitted to the decoding side. Moreover, according to an embodiment, each difference value, for which no metadata sample exists in the compressed metadata signal, received and processed by the metadata decoder. Some of the embodiments illustrated by FIGS. 10 and 11, however, realize a different concept.

Figure 10:
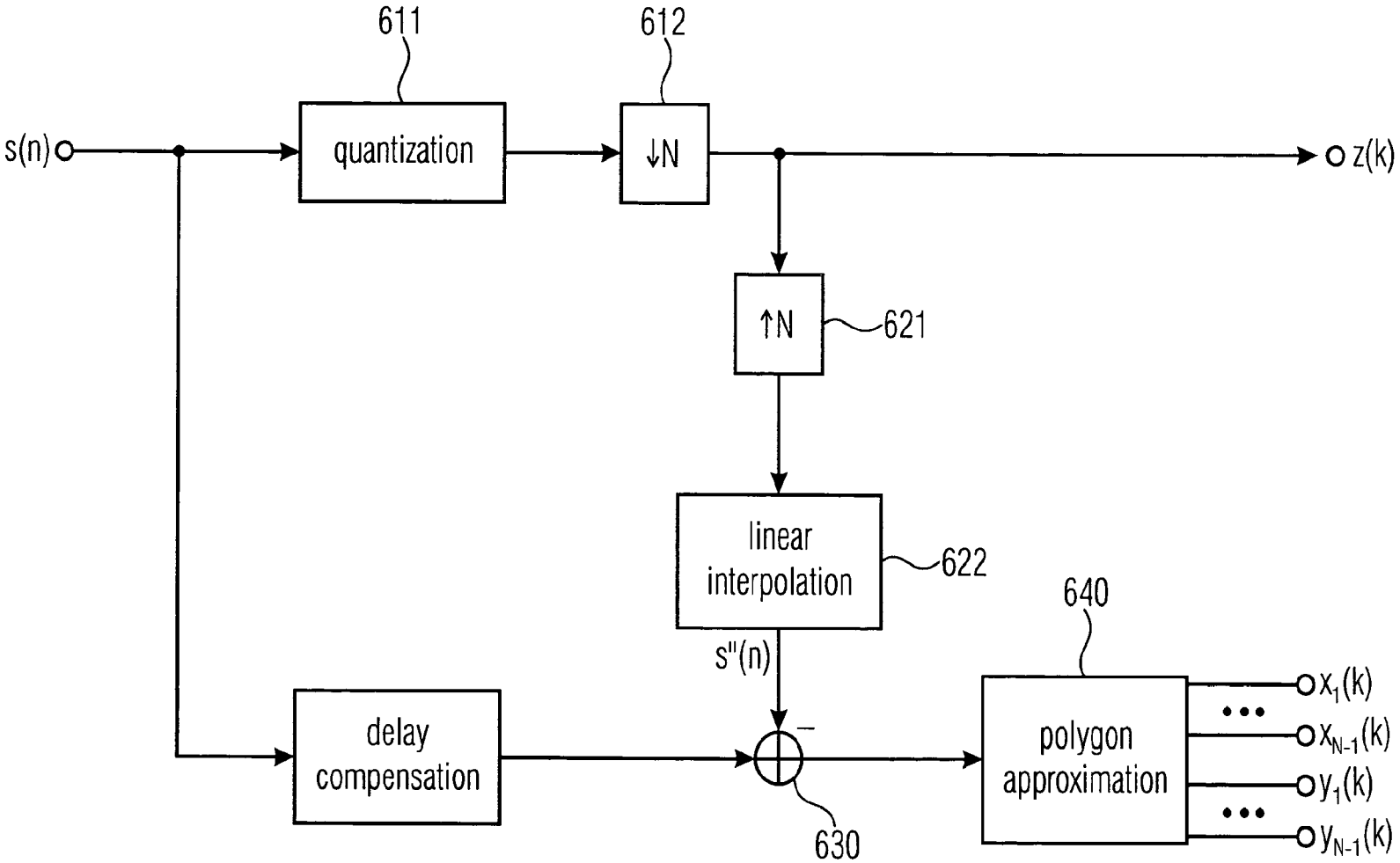
FIG. 10 illustrates a metadata encoding according to a further embodiment.

FIG. 10 illustrates a metadata encoding according to a further embodiment. A metadata encoder 210 according to embodiments may be configured to implement the metadata encoding illustrated by FIG. 10.

As in some of the embodiments before, in FIG. 10, difference values are, for example, determined for each metadata sample of the original metadata signal which is not comprised by the compressed metadata signal. E.g., when the metadata samples at time instant n=0 and time instant n=N are comprised by the compressed metadata signal, but the metadata samples at the time instants n=1 to n=N−1, then difference values are determined for the time instants n=1 to n=N−1.

However, according to the embodiment of FIG. 10, polygon approximation is then conducted in 640. The metadata encoder 210 is configured to decide, which of the difference values will be transmitted, and whether difference values will be transmitted at all.

For example, the metadata encoder 210 may be configured to transmit only those difference values having a difference value that is greater than a threshold value.

In another embodiment, the metadata encoder 210 may be configured to transmit only those difference values, when the ratio of that difference value to a corresponding metadata sample is greater than a threshold value.

In an embodiment, the metadata encoder 210 examines for the greatest absolute difference value, whether this absolute difference value is greater than a threshold value. If this absolute difference value is greater than the threshold value, then the difference value is transmitted, otherwise no difference value is transmitted and the examination ends. The examination is continued for the second biggest difference value, for the third biggest value and so on, until all of the difference values are smaller than the threshold value.

As not all difference values are necessarily transmitted, according to embodiments, the metadata encoder 210 not only encodes the (size of the) difference value itself (one of the values $y_1[k] \ldots y_{N-1}[k]$ in FIG. 10), but also transmits information to which metadata sample of the original metadata signal the difference value relates (one of the values $x_1[k] \ldots x_{N-1}[k]$ in FIG. 10). For example, the metadata encoder 210 may encode the instant of time to which the difference value relates. E.g., the metadata encoder 210 may encode a value between 1 and N−1 to indicate to which metadata sample between the metadata samples 0 and N, that are already transmitted in the compressed metadata signal, the difference value relates. Listing the values $x_1[k] \ldots x_{N-1}[k]\ y_1[k] \ldots y_{N-1}[k]$ at the output of the polygon approximation does not mean that all these values are necessarily transmitted, but instead means that none, one, some or all of these value pairs are transmitted, depending on the difference values.

In an embodiment, the metadata encoder 210 may process a segment of, e.g., N, consecutive difference values and approximates each segment by a polygon course that is formed by a variable number of quantized polygon points $[x_i, y_i]$.

It can be expected that the number of polygon points that is necessitated to approximate the difference signal with sufficient accuracy is on average significantly smaller than N. And as $[x_i, y_i]$ are small integer numbers, they can be encoded with a low number of bits.

Figure 11:
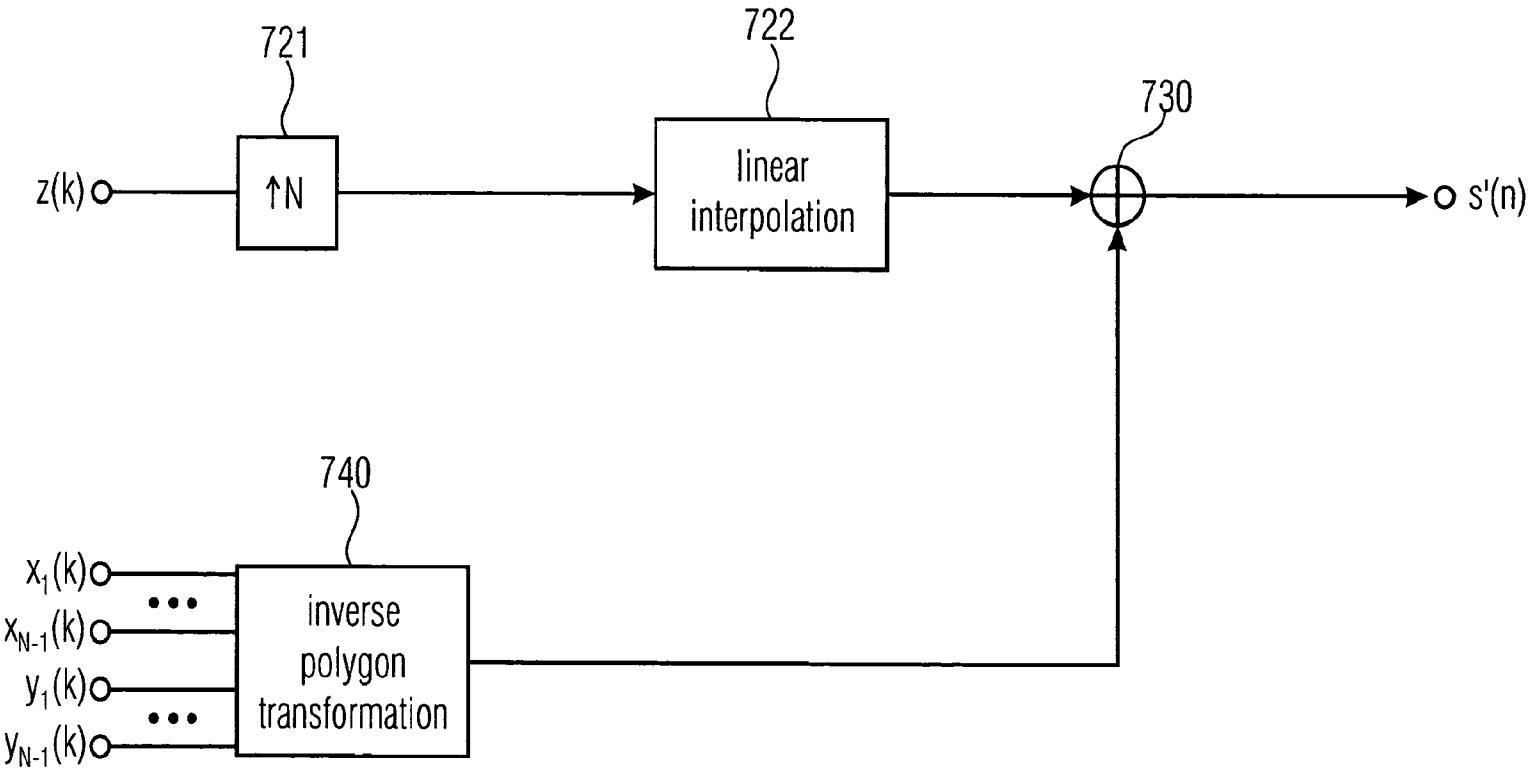
FIG. 11 illustrates a metadata decoding according to a further embodiment.

FIG. 11 illustrates a metadata decoding according to a further embodiment. A metadata decoder 110 according to embodiments may be configured to implement the metadata decoding illustrated by FIG. 11.

In embodiments, the metadata decoder 110 receives some difference values and adds these difference values to the corresponding linear interpolated metadata samples in 730.

In some embodiments, the metadata decoder 110 adds the received difference values only to the corresponding linear interpolated metadata samples in 730 and leaves the other linear interpolated metadata samples, for which no difference values are received, unaltered.

However, embodiments which realize another concept are now described.

According to such embodiments, the metadata decoder 110 is configured to receive the plurality of difference values for a compressed metadata signal of the one or more compressed metadata signals. Each of the difference values can be referred to as a "received difference value". A received difference value is assigned to one of the approximated metadata samples of the reconstructed metadata signal, which is associated with (constructed from) said compressed metadata signal, to which the received difference values relate.

As already described with respect to FIG. 9, the metadata decoder 110 is configured to add each received difference value of the plurality of received difference values to the approximated metadata sample being associated with said received difference value. By adding a received difference value to its approximated metadata sample, one of the second metadata samples of said reconstructed metadata signal is obtained.

However, for some (or sometimes, for most) of the approximated metadata samples, often, no difference values are received.

In some embodiments, the metadata decoder 110 may, e.g., be configured to determine an approximated difference value depending on one or more of the plurality of received difference values for each approximated metadata sample of the plurality of approximated metadata samples of the reconstructed metadata signal being associated with said compressed metadata signal, when none of the plurality of received difference values is associated with said approximated metadata sample.

In other words, for all those approximated metadata samples, for which no difference value is received, an approximated difference value is generated depending on one or more of the received difference values.

The metadata decoder 110 is configured to add each approximated difference value of the plurality of approximated difference values to the approximated metadata sample of said approximated difference value to obtain another one of the second metadata samples of said reconstructed metadata signal.

In other embodiments, however, metadata decoder 110 approximates difference values for those metadata samples, for which no difference values have been received, by conducting linear interpolation depending on those difference values that have been received in step 740.

For example, if a first difference value and a second difference value is received, then difference values located between these received difference values can be approximated, e.g., employing linear interpolation.

For example, when a first difference value at time instant n=15 has the difference value d[15]=5. And when a second difference value at time instant n=18 has the difference value d[18]=2, then difference values for n=16 and d=17 can be linearly approximated as d[16]=4 and d[17]=3.

In a further embodiment, when metadata samples are comprised by the compressed metadata signal, the difference values of said metadata samples is assumed to be 0, and linear interpolation of difference values which are not received may be conducted by the metadata decoder based on said metadata samples which are assumed to be zero.

For example, when a single difference value d=8 is transmitted for n=16, and when for n=0 and n=32, a metadata sample is transmitted in the compressed metadata signal, then, the not transmitted difference values at n=0 and n=32 are assumed to be 0.

Let n denote time and let d[n] be the difference value at time instant n. Then:

d[16]=8 (received difference value)

d[0]=0 (assumed difference value, as metadata sample exists in z(k))

d[32]=0 (assumed difference value, as metadata sample exists in z(k))

approximated difference values:

d[1]=0.5; d[2]=1; d[3]=1.5; d[4]=2; d[5]=2.5; d[6]=3; d[7]=3.5; d[8]=4;

d[9]=4.5; d[10]=5; d[11]=5.5; d[12]=6; d[13]=6.5; d[14]=7; d[15]=7.5;

d[17]=7.5; d[18]=7; d[19]=6.5; d[20]=6; d[21]=5.5; d[22]=5; d[23]=4.5; d[24]=4;

d[25]=3.5; d[26]=3; d[27]=2.5; d[28]=2; d[29]=1.5; d[30]=1; d[31]=0.5.

In embodiments, the received as well as the approximated difference values are added to the corresponding linear interpolated samples (in 730).

In the following, embodiments are described.

The (object) metadata encoder may, e.g., jointly encode a sequence of regularly (sub)sampled trajectory values using a look-ahead buffer of a given size N. As soon as this buffer is filled, the whole data block is encoded and transmitted. The encoded object data may consist of 2 parts, the intracoded object data and optionally a differential data part that contains the fine structure of each segment.

The intracoded object data comprises the quantized values z(k) which are sampled on a regular grid (e.g. every 32 audio frames of length 1024). Boolean variables may be used to indicate that the values are specified individually for each object or that a value follows that is common to all objects.

The decoder may be configured to derive a coarse trajectory from the intracoded object data by linear interpolation. The fine structure of the trajectories is given by the differential data part that comprises the encoded difference between the input trajectory and the linear interpolation. A polygon representation in combination with different quantization steps for the azimuth, elevation, radius, and gain values results in the desired irrelevance reduction.

The polygon representation may be obtained from a variant of the Ramer-Douglas-Peucker algorithm [10,11] that does not use a recursion and that differs from the original approach by an additional abort criterium, i.e. the maximum number of polygon points for all objects and all object components.

The resulting polygon points may be encoded in the differential data part using a variable word length that is specified within the bit stream. Additional boolean variables indicate the common encoding of equal values.

In the following, object metadata frames according to embodiments and symbol representation according to embodiments are described.

For efficiency reasons, a sequence of regularly (sub) sampled trajectory values are jointly encoded. The encoder may use a look-ahead buffer of a given size and as soon as this buffer is filled, the whole data block is encoded and transmitted. This encoded object data (e.g., payloads for object metadata) may, e.g., comprise two parts, the intracoded object data (first part) and, optionally, a differential data part (second part).

Some or all portions of the following syntax may, for example, be employed:

| | No. of bits | Mnemonic |
|---|---|---|
| object_metadata( ) | | |
| { | | |
| intracoded_object_metadata( ) | | |
| has_differential_metadata; | 1 | bslbf |
| if (has_differential_metadata) { | | |
| differential_object_metadata( ); | | |
| } | | |
| } | | |

In the following, intracoded object data according to an embodiment is described:

In order to support random access of the encoded object metadata, a complete and self-contained specification of all object metadata needs to be transmitted regularly. This is realized via intracoded object data ("I-Frames") which contain quantized values sampled on a regular grid (e.g. every 32 frames of length 1024). These I-Frames have the following syntax, where position_azimuth, position_elevation, position_radius, and gain_factor specify the quantized values in iframe_period frames after the current I-Frame:

| | No. of bits | Mnemonic |
|---|---|---|
| intracoded_object_metadata( ) | | |
| { | | |
| Ifperiod; | 6 | uimsbf |
| if (num_objects>1) { | | |
| common_azimuth; | 1 | bslbf |
| if (common_azimuth) { | | |
| default_azimuth; | 8 | tcimsbf |
| } | | |
| else { | | |
| for (o=1:num_objects) { | | |
| position_azimuth[o]; | 8 | tcimsbf |
| } | | |
| } | | |
| common_elevation; | 1 | bslbf |
| if (common_elevation) { | | |
| default_elevation; | 6 | tcimsbf |
| } | | |
| else { | | |
| for (o=1:num_objects) { | | |
| position_elevation[o]; | 6 | tcimsbf |
| } | | |
| } | | |
| common_radius; | 1 | bslbf |
| if (common_radius) { | | |
| default_radius; | 4 | uimsbf |
| } | | |
| else { | | |
| for (o=1:num_objects) { | | |
| position_radius[o]; | 4 | uimsbf |
| } | | |
| } | | |
| common_gain; | 1 | bslbf |
| if (common_gain) { | | |
| default_gain; | 7 | tcimsbf |
| } | | |
| else { | | |
| for (o=1:num_objects) { | | |
| gain_factor[o]; | 7 | tcimsbf |
| } | | |
| } | | |
| } | | |
| else { | | |
| position_azimuth; | 8 | tcimsbf |
| position_elevation; | 6 | tcimsbf |
| position_radius; | 4 | tcimsbf |
| gain_factor; | 7 | tcimsbf |
| } | | |
| } | | |

Note: iframe_period = ifperiod + 1;

In the following, differential object data according to an embodiment is described.

An approximation with greater accuracy is achieved by transmitting polygon courses based on a reduced number of sampling points. Consequently, a very sparse 3-dimensional matrix may be transmitted, where the first dimension may be the object index, the second dimension may be formed by the metadata components (azimuth, elevation, radius, and gain), and the third dimension may be the frame index of the polygon sampling points. Without further measures, the indication of which elements of the matrix comprises values already necessitates num_objects*num_components*(iframe_period−1) bits. A first step to reduce this amount of bits may be to add four flags that indicate whether there is at least one value that belongs to one of the four components. For example, it can be expected that only in rare cases there will be differential radius or gain values. The third dimension of the reduced 3-dimensional matrix comprises a vector with iframe_period−1 elements. If only a small number of polygon points is expected, then it may be more efficient to parametrize this vector by a set of frame indices and the cardinality of this set. For example, for an iframe_period of Nperiod=32 frames, a maximum number of 16 polygon points, this method may be favorable for Npoints<(32−log 2(16))/log 2(32)=5.6 polygon points. According to embodiments, the following syntax for such a coding scheme is employed:

| | No. of bits | Mnemonic |
|---|---|---|
| differential_object_metadata( ) { | | |
| bits_per_point; | 4 | uimsbf |
| fixed_azimuth; | 1 | bslbf |
| if (!fixed_azimuth) { | | |
| for (o=1:num_objects) { | | |
| flag_azimuth; | 1 | bslbf |
| if (flag_azimuth) { | | |
| num_points = offset_data( ); | | |
| nbits_azimuth; | 3 | uimsbf |
| for (p=1:num_points) { | | |
| differential_azimuth[o][p]; | num_bits | tcimsbf |
| } | | |
| } | | |
| } | | |
| } | | |
| fixed_elevation; | 1 | bslbf |
| if (!fixed_elevation) { | | |
| for (o=1:num_objects) { | | |
| flag_elevation; | 1 | bslbf |
| if (flag_elevation) { | | |
| num_points = offset_data( ); | | |
| nbits_elevation; | 3 | uimsbf |
| for (p=1:num_points) { | | |
| differential_elevation[o][p]; | num_bits | tcimsbf |
| } | | |
| } | | |
| } | | |
| } | | |
| fixed_radius; | 1 | bslbf |
| if (!fixed_radius) { | | |
| for (o=1:num_objects) { | | |
| flag_radius; | 1 | bslbf |
| if (flag_radius) { | | |
| num_points = offset_data( ); | | |
| nbits_radius | 3 | uimsbf |
| for (p=1:num_points) { | | |
| differential_radius[o][p]; | num_bits | tcimsbf |
| } | | |
| } | | |
| } | | |
| } | | |
| fixed_gain; | 1 | bslbf |
| if (!fixed_gain) { | | |
| for (o=1:num_objects) { | | |
| flag_gain; | 1 | bslbf |
| if (flag_gain) { | | |
| num_points = offset_data( ); | | |
| nbits_gain; | 3 | uimsbf |
| for (p=1:num_points) { | | |

-continued

| | No. of bits | Mnemonic |
|---|---|---|
| differential_gain[o][p]; | num_bits | tcimsbf |
| } | | |
| } | | |
| } | | |
| } | | |
| } | | |

Note: num_bits = nbits_* + 2;

| | No. of bits | Mnemonic |
|---|---|---|
| int offset_data( ) { | | |
| bitfield_syntax | 1 | bslbf |
| if (bitfield_syntax) { | | |
| offset_bitfield | iframe_period-1 | bslbf array |
| num_points = sum(offset_bitfield) | | |
| } | | |
| else { | | |
| npoints; | bits_per_point | uimsbf |
| num_points = npoints + 1; | | |
| for (p=1:num_points) { | | |
| foffset[p]; | ceil(log2(iframe_period-1)) | uimsbf |
| } | | |
| } | | |
| return num_points; | | |
| } | | |

The macro offset_data( ) encodes the positions (frame offsets) of the polygon points, either as a simple bitfield or using the concepts described above. The num_bits values allow for encoding large positional jumps while the rest of the differential data is encoded with a smaller word size.

In particular, in an embodiment, the above macros may, e.g., have the following meaning:

Definition of object_metadata( ) payloads according to an embodiment:

has_differential_metadata indicates whether differential object metadata is present.

Definition of intracoded_object_metadata( ) payloads according to an embodiment:

- ifperiod defines the number of frames in between independent frames.
- common_azimuth indicates whether a common azimuth angle is used for all objects.
- default_azimuth defines the value of the common azimuth angle.
- position_azimuth if there is no common azimuth value, a value for each object is transmitted.
- common_elevation indicates whether a common elevation angle is used for all objects.
- default_elevation defines the value of the common elevation angle.
- position_elevation if there is no common elevation value, a value for each object is transmitted.
- common_radius indicates whether a common radius value is used for all objects.
- default_radius defines the value of the common radius.
- position_radius if there is no common radius value, a value for each object is transmitted.
- common_gain indicates whether a common gain value is used for all objects.
- default_gain defines the value of the common gain factor.
- gain_factor if there is no common gain value, a value for each object is transmitted.

position_azimuth if there is only one object, this is its azimuth angle.

position_elevation if there is only one object, this is its elevation angle.

position_radius if there is only one object, this is its radius.

gain_factor if there is only one object, this is its gain factor.

Definition of differential_object_metadata( ) payloads according to an embodiment:

bits_per_point number of bits necessitated to represent number of polygon points.

fixed_azimuth flag indicating whether the azimuth value is fixed for all object.

flag_azimuth flag per object indicating whether the azimuth value changes.

nbits_azimuth how many bits are necessitated to represent the differential value.

differential_azimuth value of the difference between the linearly interpolated and the actual value.

fixed_elevation flag indicating whether the elevation value is fixed for all object.

flag_elevation flag per object indicating whether the elevation value changes.

nbits_elevation how many bits are necessitated to represent the differential value.

differential_elevation value of the difference between the linearly interpolated and the actual value.

fixed_radius flag indicating whether the radius is fixed for all object.

flag_radius flag per object indicating whether the radius changes.

nbits_radius how many bits are necessitated to represent the differential value.

differential_radius value of the difference between the linearly interpolated and the actual value.

fixed_gain flag indicating whether the gain factor is fixed for all object.

flag_gain flag per object indicating whether the gain radius changes.

nbits_gain how many bits are necessitated to represent the differential value.

differential_gain value of the difference between the linearly interpolated and the actual value.

Definition of offset_data( ) payloads according to an embodiment:

bitfield_syntax flag indicating whether a vector with polygon indices is present in the bit stream.

offset_bitfield bool array containing a flag for each point of the iframe_period whether it is an a polygon point or not.

npoints number of polygon points minus 1 (num_points=npoints+1).

foffset time slice index of the polygon points within iframe_period (frame_offset=foffset+1).

According to an embodiment, metadata may, for example, be conveyed for every audio object as given positions (e.g., indicated by azimuth, elevation, and radius) at defined timestamps.

In conventional technology, no flexible technology exists combining channel coding on the one hand and object coding on the other hand so that acceptable audio qualities at low bit rates are obtained.

This limitation is overcome by the 3D Audio Codec System. Now, the 3D Audio Codec System is described.

Figure 12:
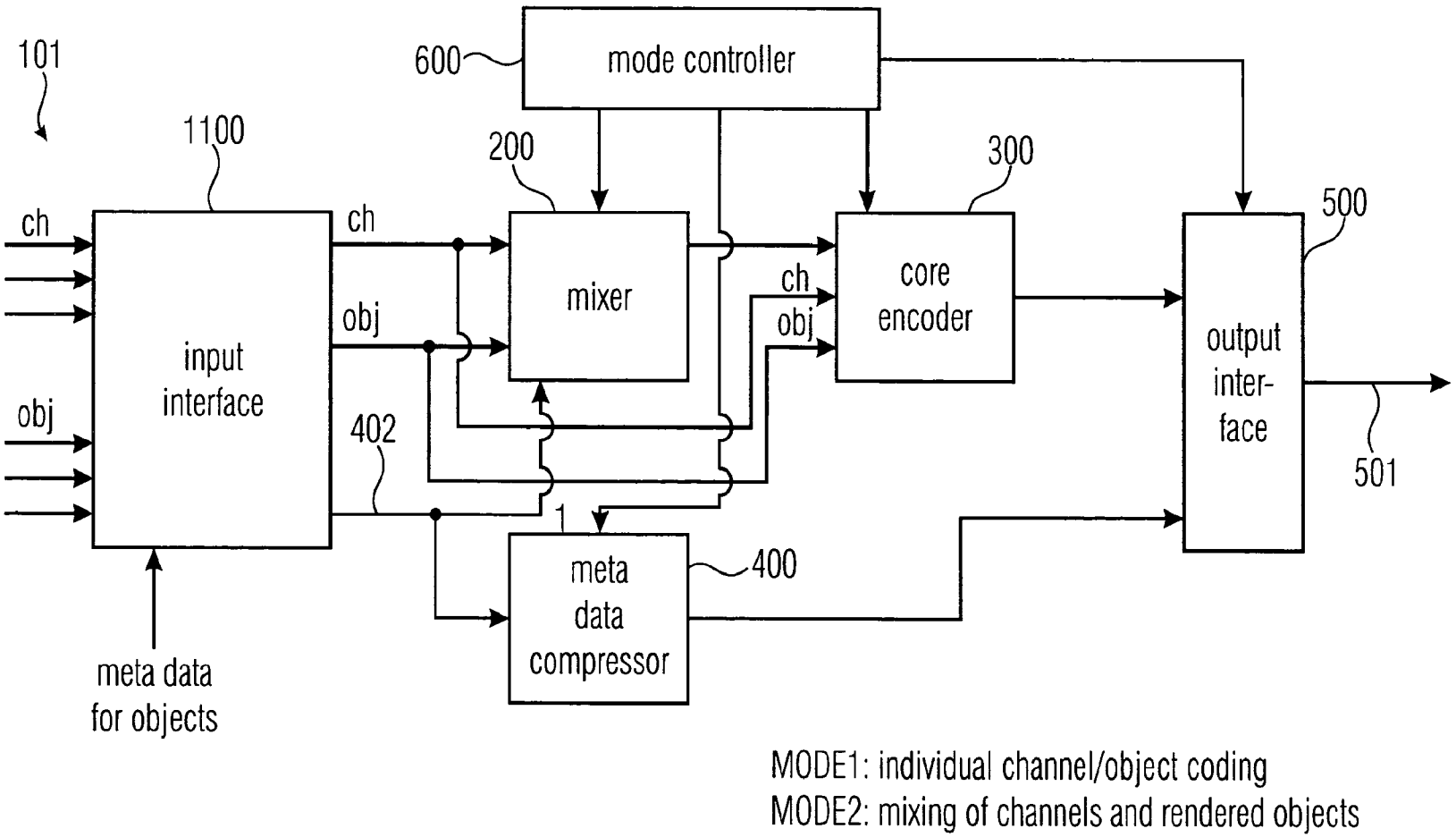
FIG. 12 illustrates a first embodiment of a 3D audio encoder.

FIG. 12 illustrates a 3D audio encoder in accordance with an embodiment of the present invention. The 3D audio encoder is configured for encoding audio input data 101 to obtain audio output data 501. The 3D audio encoder comprises an input interface for receiving a plurality of audio channels indicated by CH and a plurality of audio objects indicated by OBJ. Furthermore, as illustrated in FIG. 12, the input interface 1100 additionally receives metadata related to one or more of the plurality of audio objects OBJ. Furthermore, the 3D audio encoder comprises a mixer 200 for mixing the plurality of objects and the plurality of channels to obtain a plurality of pre-mixed channels, wherein each pre-mixed channel comprises audio data of a channel and audio data of at least one object.

Furthermore, the 3D audio encoder comprises a core encoder 300 for core encoding core encoder input data, a metadata compressor 400 for compressing the metadata related to the one or more of the plurality of audio objects.

Furthermore, the 3D audio encoder can comprise a mode controller 600 for controlling the mixer, the core encoder and/or an output interface 500 in one of several operation modes, wherein in the first mode, the core encoder is configured to encode the plurality of audio channels and the plurality of audio objects received by the input interface 1100 without any interaction by the mixer, i.e., without any mixing by the mixer 200. In a second mode, however, in which the mixer 200 was active, the core encoder encodes the plurality of mixed channels, i.e., the output generated by block 200. In this latter case, it is advantageous to not encode any object data anymore. Instead, the metadata indicating positions of the audio objects are already used by the mixer 200 to render the objects onto the channels as indicated by the metadata. In other words, the mixer 200 uses the metadata related to the plurality of audio objects to pre-render the audio objects and then the pre-rendered audio objects are mixed with the channels to obtain mixed channels at the output of the mixer. In this embodiment, any objects may not necessarily be transmitted and this also applies for compressed metadata as output by block 400. However, if not all objects input into the interface 1100 are mixed but only a certain amount of objects is mixed, then only the remaining non-mixed objects and the associated metadata nevertheless are transmitted to the core encoder 300 or the metadata compressor 400, respectively.

In FIG. 12, the meta data compressor 400 is the metadata encoder 210 of an apparatus 250 for generating encoded audio information according to one of the above-described embodiments. Moreover, in FIG. 12, the mixer 200 and the core encoder 300 together form the audio encoder 220 of an apparatus 250 for generating encoded audio information according to one of the above-described embodiments.

Figure 14:
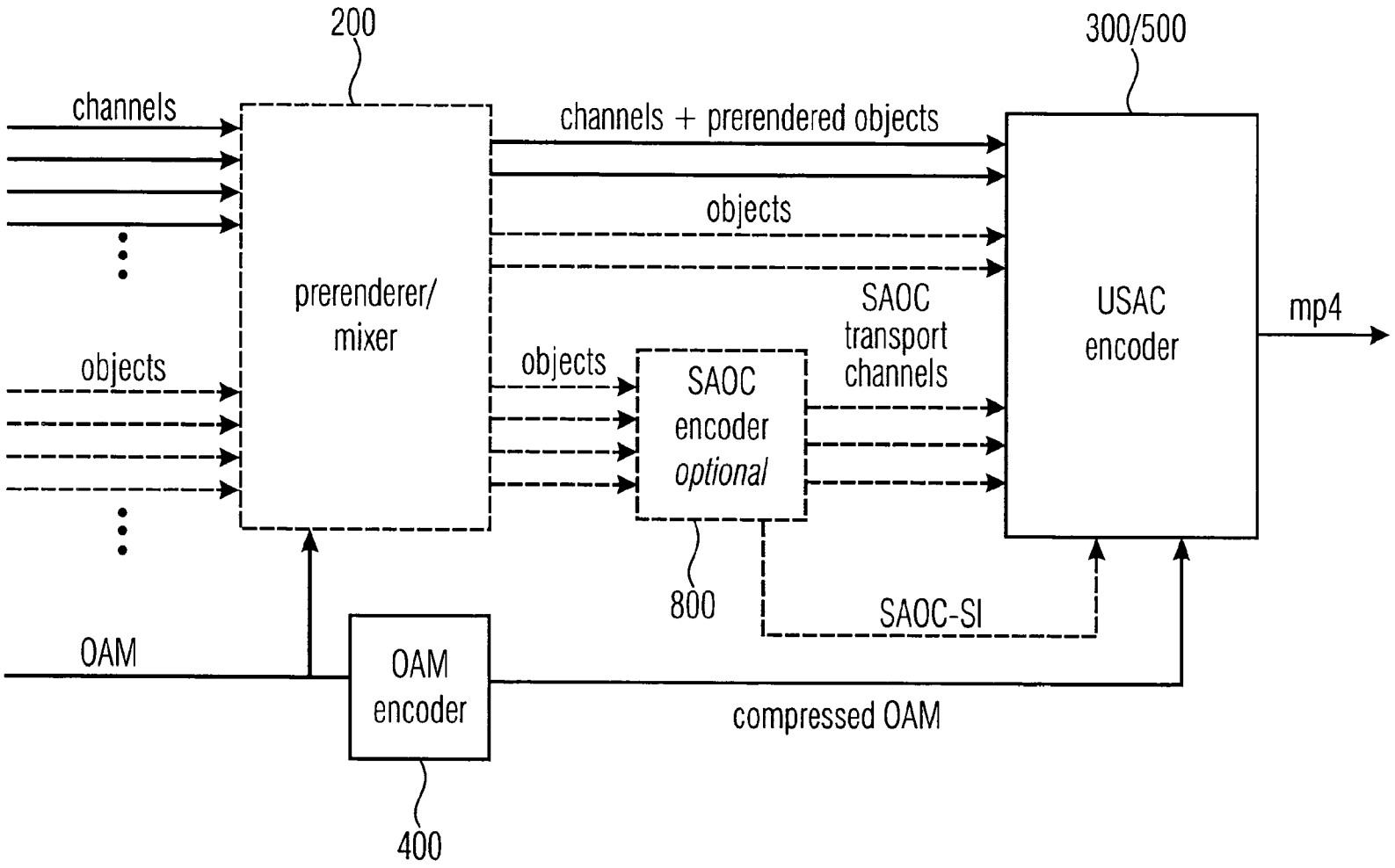
FIG. 14 illustrates a second embodiment of a 3D audio encoder.

FIG. 14 illustrates a further embodiment of an 3D audio encoder which, additionally, comprises an SAOC encoder 800. The SAOC encoder 800 is configured for generating one or more transport channels and parametric data from spatial audio object encoder input data. As illustrated in FIG. 14, the spatial audio object encoder input data are objects which have not been processed by the pre-renderer/mixer. Alternatively, provided that the pre-renderer/mixer has been bypassed as in the mode one where an individual channel/object coding is active, all objects input into the input interface 1100 are encoded by the SAOC encoder 800.

Furthermore, as illustrated in FIG. 14, the core encoder 300 is implemented as a USAC encoder, i.e., as an encoder as defined and standardized in the MPEG-USAC standard (USAC=unified speech and audio coding). The output of the whole 3D audio encoder illustrated in FIG. 14 is an MPEG 4 data stream having the container-like structures for individual data types. Furthermore, the metadata is indicated as "OAM" data and the metadata compressor 400 in FIG. 12 corresponds to the OAM encoder 400 to obtain compressed OAM data which are input into the USAC encoder 300 which, as can be seen in FIG. 14, additionally comprises the output interface to obtain the MP4 output data stream not only having the encoded channel/object data but also having the compressed OAM data.

In FIG. 14, the OAM encoder 400 is the metadata encoder 210 of an apparatus 250 for generating encoded audio information according to one of the above-described embodiments. Moreover, in FIG. 14, the SAOC encoder 800 and the USAC encoder 300 together form the audio encoder 220 of an apparatus 250 for generating encoded audio information according to one of the above-described embodiments.

Figure 16:
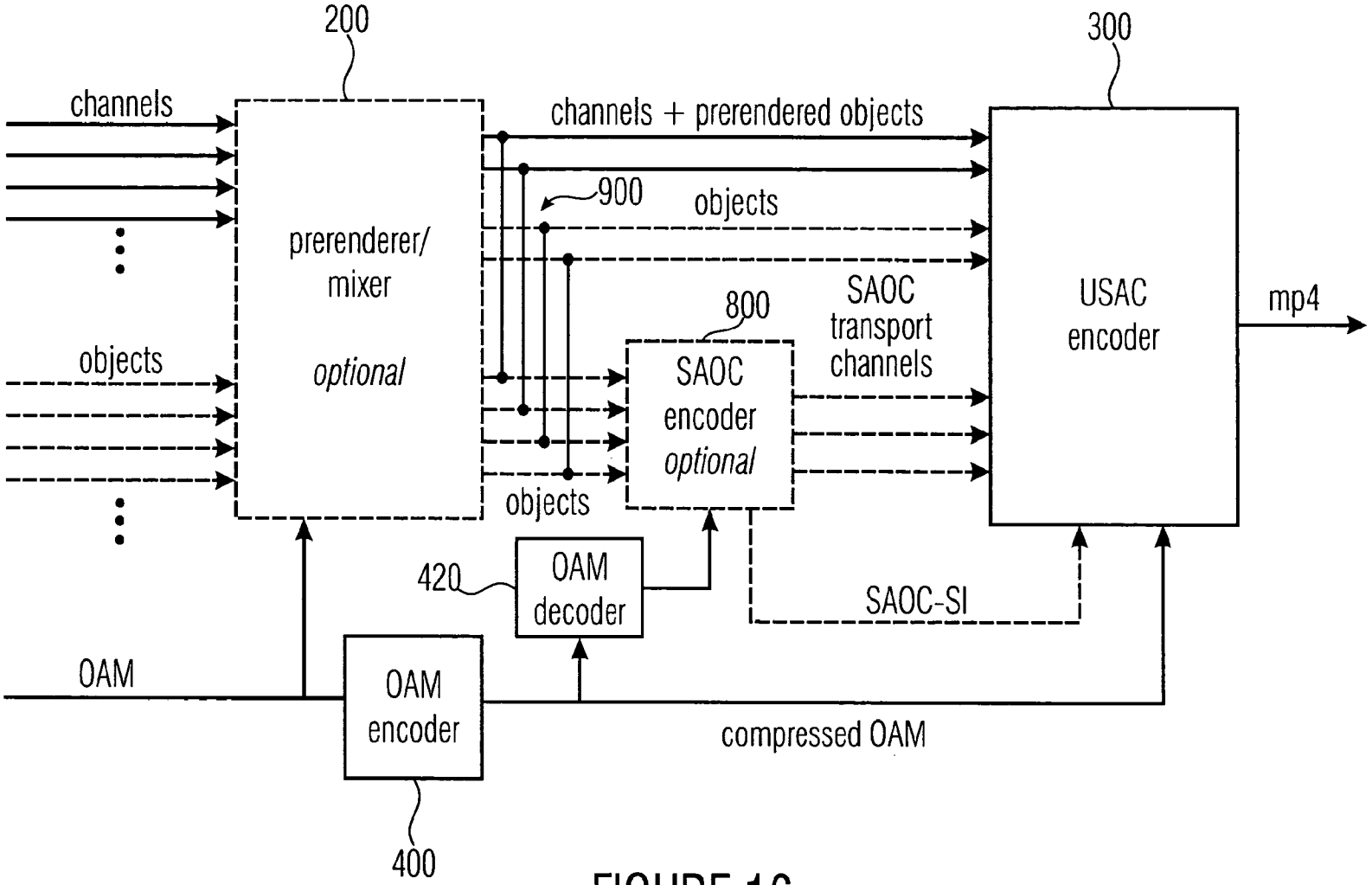
FIG. 16 illustrates a third embodiment of a 3D audio encoder.

FIG. 16 illustrates a further embodiment of the 3D audio encoder, where in contrast to FIG. 14, the SAOC encoder can be configured to either encode, with the SAOC encoding algorithm, the channels provided at the pre-renderer/mixer 200 not being active in this mode or, alternatively, to SAOC encode the pre-rendered channels plus objects. Thus, in FIG. 16, the SAOC encoder 800 can operate on three different kinds of input data, i.e., channels without any pre-rendered objects, channels and pre-rendered objects or objects alone. Furthermore, it is advantageous to provide an additional OAM decoder 420 in FIG. 16 so that the SAOC encoder 800 uses, for its processing, the same data as on the decoder side, i.e., data obtained by a lossy compression rather than the original OAM data.

The FIG. 16 3D audio encoder can operate in several individual modes.

In addition to the first and the second modes as discussed in the context of FIG. 12, the FIG. 16 3D audio encoder can additionally operate in a third mode in which the core encoder generates the one or more transport channels from the individual objects when the pre-renderer/mixer 200 was not active. Alternatively or additionally, in this third mode the SAOC encoder 800 can generate one or more alternative or additional transport channels from the original channels, i.e., again when the pre-renderer/mixer 200 corresponding to the mixer 200 of FIG. 12 was not active.

Finally, the SAOC encoder 800 can encode, when the 3D audio encoder is configured in the fourth mode, the channels plus pre-rendered objects as generated by the pre-renderer/mixer. Thus, in the fourth mode the lowest bit rate applications will provide good quality due to the fact that the channels and objects have completely been transformed into individual SAOC transport channels and associated side information as indicated in FIGS. 3 and 5 as "SAOC-SI" and, additionally, any compressed metadata do not have to be transmitted in this fourth mode.

In FIG. 16, the OAM encoder 400 is the metadata encoder 210 of an apparatus 250 for generating encoded audio information according to one of the above-described embodiments. Moreover, in FIG. 16, the SAOC encoder 800 and the USAC encoder 300 together form the audio encoder 220 of an apparatus 250 for generating encoded audio information according to one of the above-described embodiments.

According to an embodiment, an apparatus for encoding audio input data 101 to obtain audio output data 501 is provided. The apparatus for encoding audio input data 101 comprises:

an input interface 1100 for receiving a plurality of audio channels, a plurality of audio objects and metadata related to one or more of the plurality of audio objects, a mixer 200 for mixing the plurality of objects and the plurality of channels to obtain a plurality of pre-mixed channels, each pre-mixed channel comprising audio data of a channel and audio data of at least one object, and an apparatus 250 for generating encoded audio information which comprises a metadata encoder and an audio encoder as described above.

The audio encoder 220 of the apparatus 250 for generating encoded audio information is a core encoder (300) for core encoding core encoder input data.

The metadata encoder 210 of the apparatus 250 for generating encoded audio information is a metadata compressor 400 for compressing the metadata related to the one or more of the plurality of audio objects.

Figure 13:
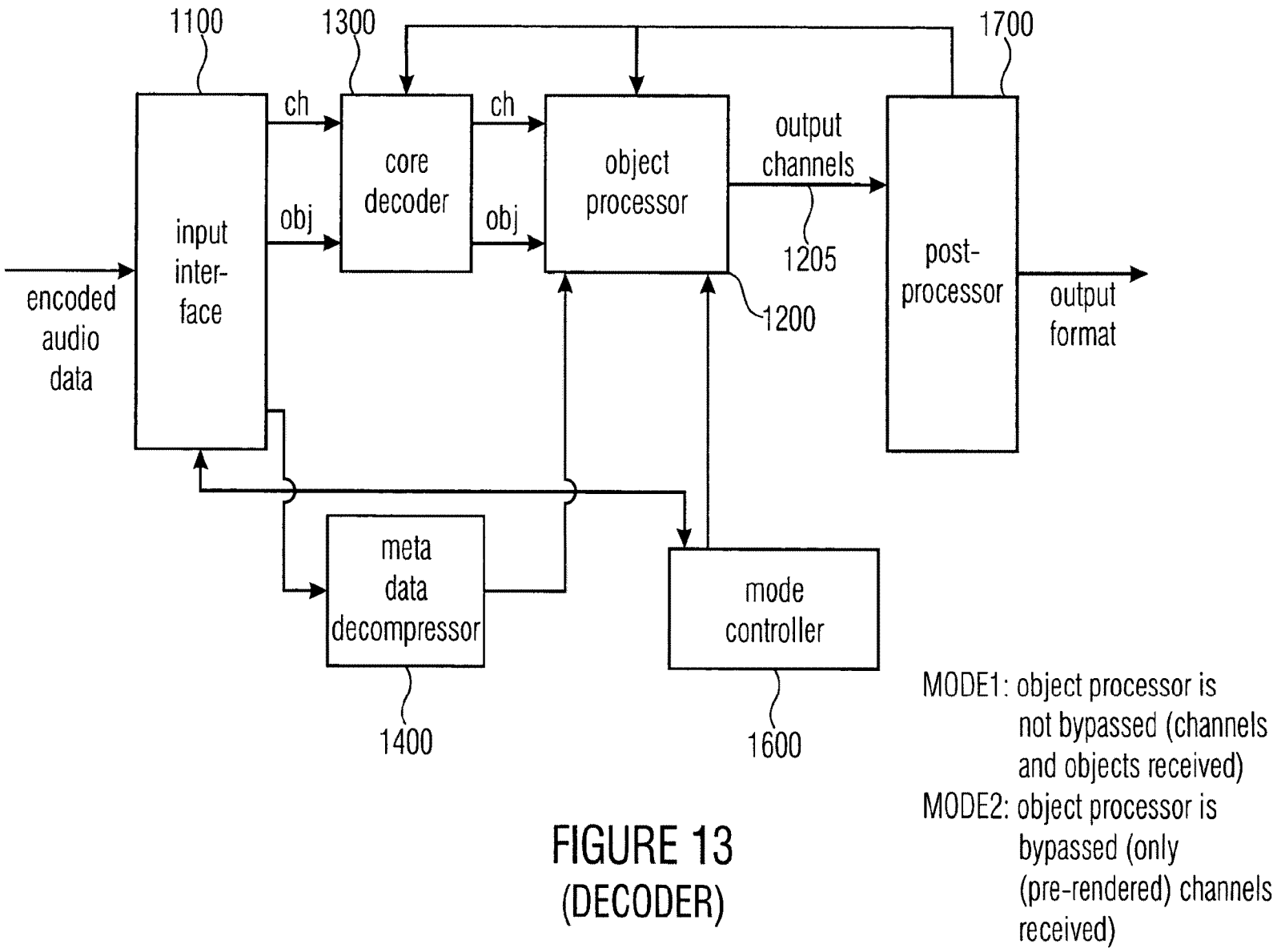
FIG. 13 illustrates a first embodiment of a 3D audio decoder.

FIG. 13 illustrates a 3D audio decoder in accordance with an embodiment of the present invention. The 3D audio decoder receives, as an input, the encoded audio data, i.e., the data 501 of FIG. 12.

The 3D audio decoder comprises a metadata decompressor 1400, a core decoder 1300, an object processor 1200, a mode controller 1600 and a postprocessor 1700.

Specifically, the 3D audio decoder is configured for decoding encoded audio data and the input interface is configured for receiving the encoded audio data, the encoded audio data comprising a plurality of encoded channels and the plurality of encoded objects and compressed metadata related to the plurality of objects in a certain mode.

Furthermore, the core decoder 1300 is configured for decoding the plurality of encoded channels and the plurality of encoded objects and, additionally, the metadata decompressor is configured for decompressing the compressed metadata.

Furthermore, the object processor 1200 is configured for processing the plurality of decoded objects as generated by the core decoder 1300 using the decompressed metadata to obtain a predetermined number of output channels comprising object data and the decoded channels. These output channels as indicated at 1205 are then input into a postprocessor 1700. The postprocessor 1700 is configured for converting the number of output channels 1205 into a certain output format which can be a binaural output format or a loudspeaker output format such as a 5.1, 7.1, etc., output format.

The 3D audio decoder comprises a mode controller 1600 which is configured for analyzing the encoded data to detect a mode indication. Therefore, the mode controller 1600 is connected to the input interface 1100 in FIG. 13. However, alternatively, the mode controller does not necessarily have to be there. Instead, the flexible audio decoder can be pre-set by any other kind of control data such as a user input or any other control. The 3D audio decoder in FIG. 13 and controlled by the mode controller 1600, is configured to either bypass the object processor and to feed the plurality of decoded channels into the postprocessor 1700. This is the operation in mode 2, i.e., in which only pre-rendered channels are received, i.e., when mode 2 has been applied in the 3D audio encoder of FIG. 12. Alternatively, when mode 1 has been applied in the 3D audio encoder, i.e., when the 3D audio encoder has performed individual channel/object coding, then the object processor 1200 is not bypassed, but the plurality of decoded channels and the plurality of decoded objects are fed into the object processor 1200 together with decompressed metadata generated by the metadata decompressor 1400.

The indication whether mode 1 or mode 2 is to be applied is included in the encoded audio data and then the mode controller 1600 analyses the encoded data to detect a mode indication. Mode 1 is used when the mode indication indicates that the encoded audio data comprises encoded channels and encoded objects and mode 2 is applied when the mode indication indicates that the encoded audio data does not contain any audio objects, i.e., only contain pre-rendered channels obtained by mode 2 of the FIG. 12 3D audio encoder.

In FIG. 13, the meta data decompressor 1400 is the metadata decoder 110 of an apparatus 100 for generating one or more audio channels according to one of the above-described embodiments. Moreover, in FIG. 13, the core decoder 1300, the object processor 1200 and the post processor 1700 together form the audio decoder 120 of an apparatus 100 for generating one or more audio channels according to one of the above-described embodiments.

Figure 15:
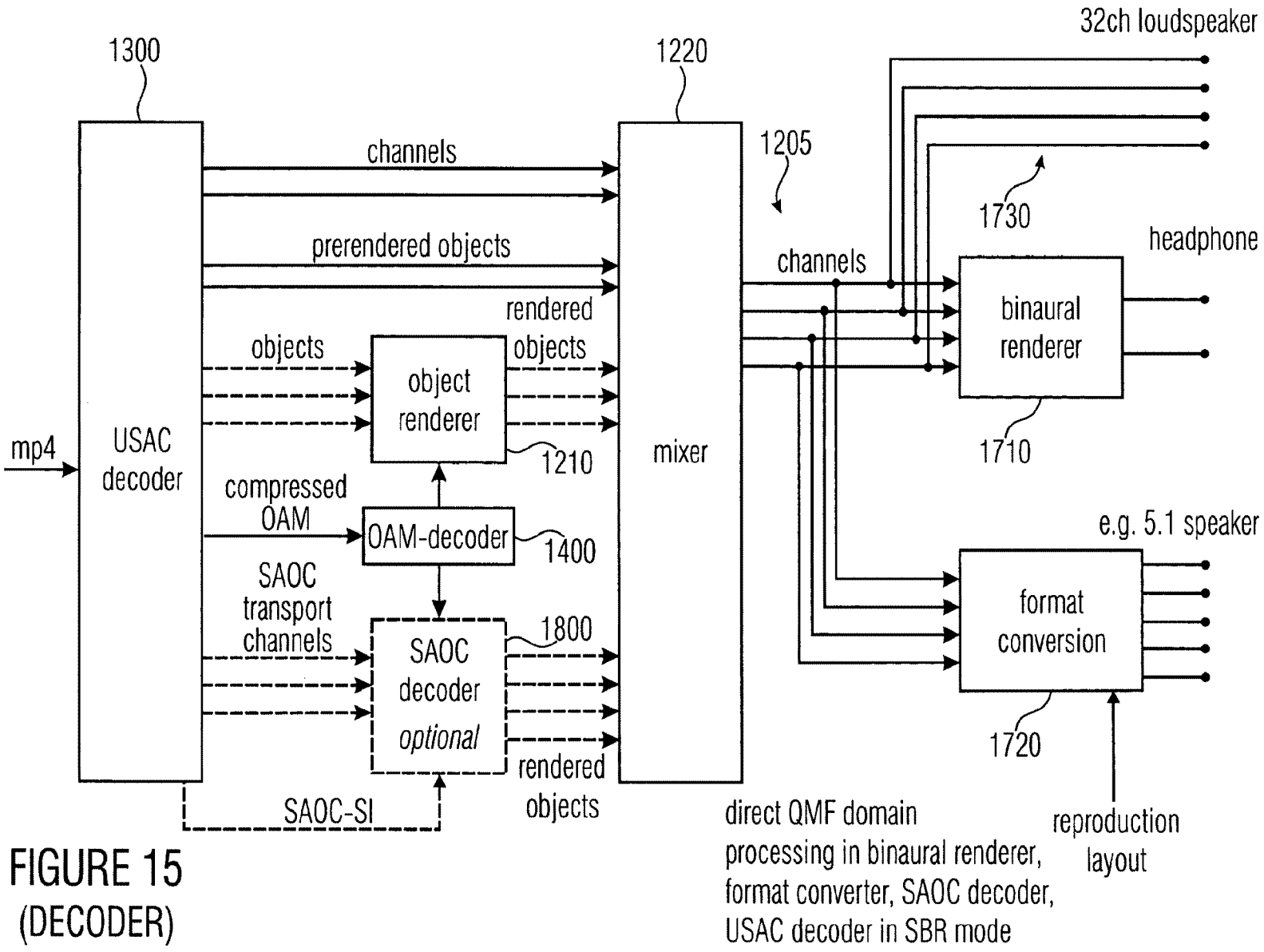
FIG. 15 illustrates a second embodiment of a 3D audio decoder.

FIG. 15 illustrates an embodiment compared to the FIG. 13 3D audio decoder and the embodiment of FIG. 15 corresponds to the 3D audio encoder of FIG. 14. In addition to the 3D audio decoder implementation of FIG. 13, the 3D audio decoder in FIG. 15 comprises an SAOC decoder 1800. Furthermore, the object processor 1200 of FIG. 13 is implemented as a separate object renderer 1210 and the mixer 1220 while, depending on the mode, the functionality of the object renderer 1210 can also be implemented by the SAOC decoder 1800.

Furthermore, the postprocessor 1700 can be implemented as a binaural renderer 1710 or a format converter 1720. Alternatively, a direct output of data 1205 of FIG. 13 can also be implemented as illustrated by 1730. Therefore, it is advantageous to perform the processing in the decoder on the highest number of channels such as 22.2 or 32 in order to have flexibility and to then post-process if a smaller format is necessitated. However, when it becomes clear from the very beginning that only small format such as a 5.1 format is necessitated, then it is advantageous, as indicated by FIG. 13 or 6 by the shortcut 1727, that a certain control over the SAOC decoder and/or the USAC decoder can be applied in order to avoid unnecessitated upmixing operations and subsequent downmixing operations.

In an embodiment of the present invention, the object processor 1200 comprises the SAOC decoder 1800 and the SAOC decoder is configured for decoding one or more transport channels output by the core decoder and associated parametric data and using decompressed metadata to obtain the plurality of rendered audio objects. To this end, the OAM output is connected to box 1800.

Furthermore, the object processor 1200 is configured to render decoded objects output by the core decoder which are not encoded in SAOC transport channels but which are individually encoded in typically single channeled elements as indicated by the object renderer 1210. Furthermore, the decoder comprises an output interface corresponding to the output 1730 for outputting an output of the mixer to the loudspeakers.

In a further embodiment, the object processor 1200 comprises a spatial audio object coding decoder 1800 for decoding one or more transport channels and associated parametric side information representing encoded audio signals or encoded audio channels, wherein the spatial audio object coding decoder is configured to transcode the associated parametric information and the decompressed metadata into transcoded parametric side information usable for directly rendering the output format, as for example defined in an earlier version of SAOC. The postprocessor 1700 is configured for calculating audio channels of the output format using the decoded transport channels and the transcoded parametric side information. The processing performed by the post processor can be similar to the MPEG Surround processing or can be any other processing such as BCC processing or so.

In a further embodiment, the object processor 1200 comprises a spatial audio object coding decoder 1800 configured to directly upmix and render channel signals for the output format using the decoded (by the core decoder) transport channels and the parametric side information Furthermore, and importantly, the object processor 1200 of FIG. 13 additionally comprises the mixer 1220 which receives, as an input, data output by the USAC decoder 1300 directly when pre-rendered objects mixed with channels exist, i.e., when the mixer 200 of FIG. 12 was active. Additionally, the mixer 1220 receives data from the object renderer performing object rendering without SAOC decoding. Furthermore, the mixer receives SAOC decoder output data, i.e., SAOC rendered objects.

The mixer 1220 is connected to the output interface 1730, the binaural renderer 1710 and the format converter 1720. The binaural renderer 1710 is configured for rendering the output channels into two binaural channels using head related transfer functions or binaural room impulse responses (BRIR). The format converter 1720 is configured for converting the output channels into an output format having a lower number of channels than the output channels 1205 of the mixer and the format converter 1720 necessitates information on the reproduction layout such as 5.1 speakers or so.

In FIG. 15, the OAM-Decoder 1400 is the metadata decoder 110 of an apparatus 100 for generating one or more audio channels according to one of the above-described embodiments. Moreover, in FIG. 15, the Object Renderer 1210, the USAC decoder 1300 and the mixer 1220 together form the audio decoder 120 of an apparatus 100 for generating one or more audio channels according to one of the above-described embodiments.

Figure 17:
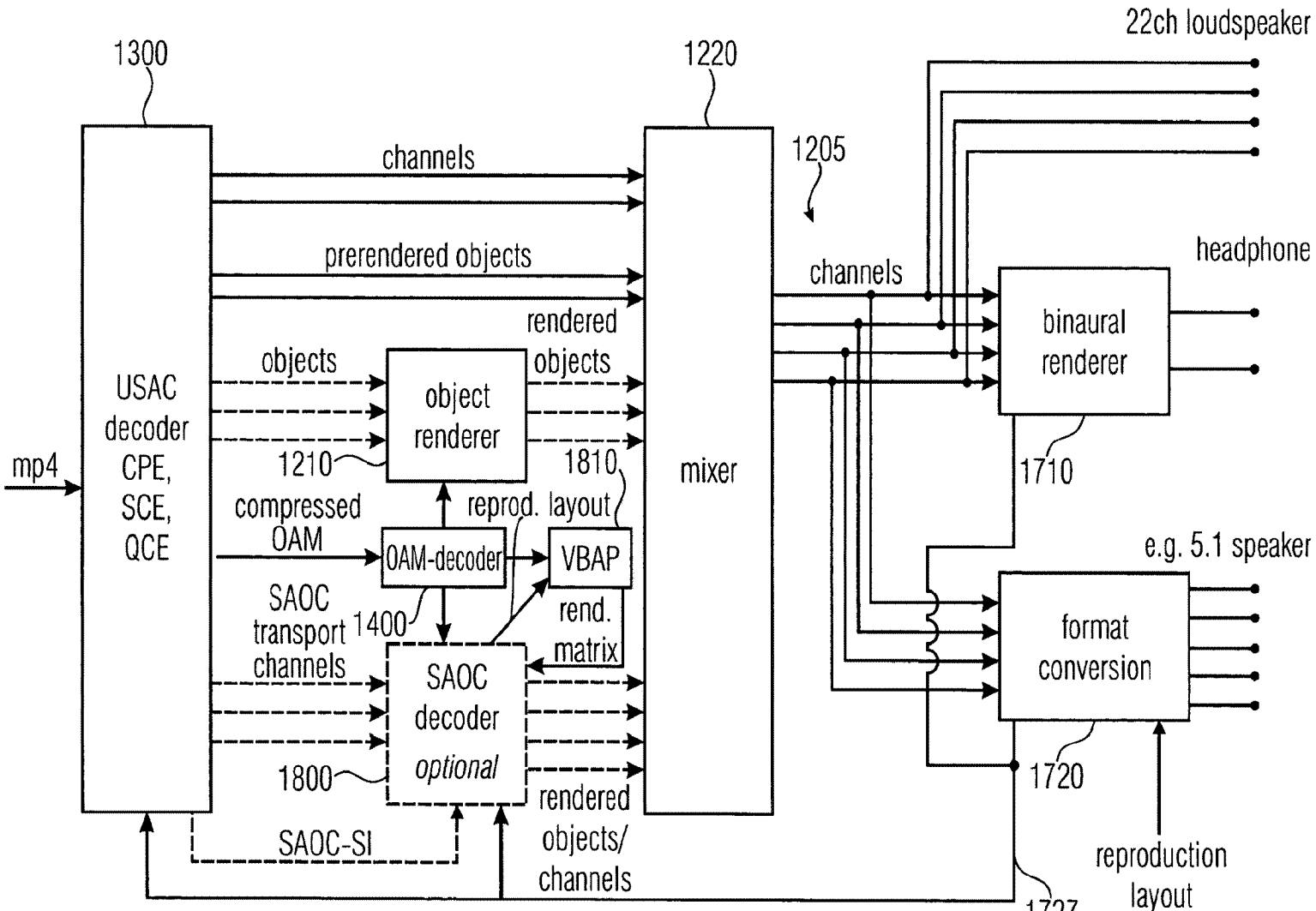
FIG. 17 illustrates a third embodiment of a 3D audio decoder.

The FIG. 17 3D audio decoder is different from the FIG. 15 3D audio decoder in that the SAOC decoder cannot only generate rendered objects but also rendered channels and this is the case when the FIG. 16 3D audio encoder has been used and the connection 900 between the channels/pre-rendered objects and the SAOC encoder 800 input interface is active.

Furthermore, a vector base amplitude panning (VBAP) stage 1810 is configured which receives, from the SAOC decoder, information on the reproduction layout and which outputs a rendering matrix to the SAOC decoder so that the SAOC decoder can, in the end, provide rendered channels without any further operation of the mixer in the high channel format of 1205, i.e., 32 loudspeakers.

The VBAP block receives the decoded OAM data to derive the rendering matrices. More general, it necessitates geometric information not only of the reproduction layout but also of the positions where the input signals should be rendered to on the reproduction layout. This geometric input data can be OAM data for objects or channel position information for channels that have been transmitted using SAOC.

However, if only a specific output interface is necessitated then the VBAP state 1810 can already provide the necessitated rendering matrix for the e.g., 5.1 output. The SAOC decoder 1800 then performs a direct rendering from the SAOC transport channels, the associated parametric data and decompressed metadata, a direct rendering into the necessitated output format without any interaction of the mixer 1220. However, when a certain mix between modes is applied, i.e., where several channels are SAOC encoded but not all channels are SAOC encoded or where several objects are SAOC encoded but not all objects are SAOC encoded or when only a certain amount of pre-rendered objects with channels are SAOC decoded and remaining channels are not SAOC processed then the mixer will put together the data from the individual input portions, i.e., directly from the core decoder 1300, from the object renderer 1210 and from the SAOC decoder 1800.

In FIG. 17, the OAM-Decoder 1400 is the metadata decoder 110 of an apparatus 100 for generating one or more audio channels according to one of the above-described embodiments. Moreover, in FIG. 17, the Object Renderer 1210, the USAC decoder 1300 and the mixer 1220 together form the audio decoder 120 of an apparatus 100 for generating one or more audio channels according to one of the above-described embodiments.

An apparatus for decoding encoded audio data is provided. The apparatus for decoding encoded audio data comprises:

- an input interface 1100 for receiving the encoded audio data, the encoded audio data comprising a plurality of encoded channels or a plurality of encoded objects or compress metadata related to the plurality of objects, and
- an apparatus 100 comprising a metadata decoder 110 and an audio channel generator 120 for generating one or more audio channels as described above.

The metadata decoder 110 of the apparatus 100 for generating one or more audio channels is a metadata decompressor 400 for decompressing the compressed metadata.

The audio channel generator 120 of the apparatus 100 for generating one or more audio channels comprises a core decoder 1300 for decoding the plurality of encoded channels and the plurality of encoded objects.

Moreover, the audio channel generator 120 further comprises an object processor 1200 for processing the plurality of decoded objects using the decompressed metadata to obtain a number of output channels 1205 comprising audio data from the objects and the decoded channels.

Furthermore, the audio channel generator 120 further comprises a post processor 1700 for converting the number of output channels 1205 into an output format.

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus.

The inventive decomposed signal can be stored on a digital storage medium or can be transmitted on a transmission medium such as a wireless transmission medium or a wired transmission medium such as the Internet.

Depending on certain implementation requirements, embodiments of the invention can be implemented in hardware or in software. The implementation can be performed using a digital storage medium, for example a floppy disk, a DVD, a CD, a ROM, a PROM, an EPROM, an EEPROM or a FLASH memory, having electronically readable control signals stored thereon, which cooperate (or are capable of cooperating) with a programmable computer system such that the respective method is performed.

Some embodiments according to the invention comprise a non-transitory data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods are performed by any hardware apparatus.

While this invention has been described in terms of several advantageous embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

REFERENCES

[1] Peters, N., Lossius, T. and Schacher J. C., "SpatDIF: Principles, Specification, and Examples", 9th Sound and Music Computing Conference, Copenhagen, Denmark, July 2012.

[2] Wright, M., Freed, A., "Open Sound Control: A New Protocol for Communicating with Sound Synthesizers", International Computer Music Conference, Thessaloniki, Greece, 1997.

[3] Matthias Geier, Jens Ahrens, and Sascha Spors. (2010), "Object-based audio reproduction and the audio scene description format", Org. Sound, Vol. 15, No. 3, pp. 219-227, December 2010.

[4] W3C, "Synchronized Multimedia Integration Language (SMIL 3.0)", December 2008.

[5] W3C, "Extensible Markup Language (XML) 1.0 (Fifth Edition)", November 2008.

[6] MPEG, "ISO/IEC International Standard 14496-3—Coding of audio-visual objects, Part 3 Audio", 2009.

[7] Schmidt, J.; Schroeder, E. F. (2004), "New and Advanced Features for Audio Presentation in the MPEG-4 Standard", 116th AES Convention, Berlin, Germany, May 2004

[8] Web3D, "International Standard ISO/IEC 14772-1: 1997—The Virtual Reality Modeling Language (VRML), Part 1: Functional specification and UTF-8 encoding", 1997.

[9] Sporer, T. (2012), "Codierung räumlicher Audiosignale mit leicht-gewichtigen Audio-Objekten", Proc. Annual Meeting of the German Audiological Society (DGA), Erlangen, Germany, March 2012.

[10] Ramer, U. (1972), "An iterative procedure for the polygonal approximation of plane curves", Computer Graphics and Image Processing, 1(3), 244-256.

[11] Douglas, D.; Peucker, T. (1973), "Algorithms for the reduction of the number of points required to represent a digitized line or its caricature", The Canadian Cartographer 10(2), 112-122.

[12] Ville Pulkki, "Virtual Sound Source Positioning Using Vector Base Amplitude Panning"; J. Audio Eng. Soc., Volume 45, Issue 6, pp. 456-466, June 1997.

The invention claimed is:

1. An apparatus for generating one or more audio channels, wherein the apparatus comprises:

a metadata decoder for receiving one or more compressed metadata signals, wherein each of the one or more compressed metadata signals comprises a plurality of first metadata samples, wherein the metadata decoder is configured to generate one or more reconstructed metadata signals, so that each reconstructed metadata signal of the one or more reconstructed metadata signals comprises the first metadata samples of a compressed metadata signal of the one or more compressed metadata signals, said reconstructed metadata signal being associated with said compressed metadata signal, and further comprises a plurality of second metadata samples, wherein the metadata decoder is configured to generate the second metadata samples of each of the one or more reconstructed metadata signals by generating a plurality of approximated metadata samples for said reconstructed metadata signal, wherein the metadata decoder is configured to generate each of the plurality of approximated metadata samples depending on at least two of the first metadata samples of said reconstructed metadata signal, and an audio channel generator for generating the one or more audio channels depending on one or more audio object signals and depending on the one or more reconstructed metadata signals, wherein the metadata decoder is configured to receive a plurality of difference values for a compressed metadata signal of the one or more compressed metadata signals, and is configured to add each of the plurality of difference values to one of the approximated metadata samples of the reconstructed metadata signal being associated with said compressed metadata signal to acquire the second metadata samples of said reconstructed metadata signal.

2. An apparatus according to claim 1, wherein the metadata decoder is configured to generate each reconstructed metadata signal of the one or more reconstructed metadata signals by upsampling one of the one or more compressed metadata signals, wherein the metadata decoder is configured to generate each of the second metadata samples of each reconstructed metadata signal of the one or more reconstructed metadata signals by conducting a linear interpolation depending on at least two of the first metadata samples of said reconstructed metadata signal.

3. An apparatus according to claim 1, wherein the metadata decoder is configured to receive the plurality of difference values for a compressed metadata signal of the one or more compressed metadata signals, wherein each of the difference values is a received difference value being assigned to one of the approximated metadata samples of the reconstructed metadata signal being associated with said compressed metadata signal, wherein the metadata decoder is configured to add each received difference value of the plurality of received difference values to the approximated metadata sample being associated with said received difference value to acquire one of the second metadata samples of said reconstructed metadata signal, wherein the metadata decoder is configured to determine an approximated difference value depending on one or more of the plurality of received difference values for each approximated metadata sample of the plurality of approximated metadata samples of the reconstructed metadata signal being associated with said compressed metadata signal, when none of the plurality of received difference values is associated with said approximated metadata sample, wherein the metadata decoder is configured to add each approximated difference value of the plurality of approximated difference values to the approximated metadata sample of said approximated difference value to acquire another one of the second metadata samples of said reconstructed metadata signal.

4. An apparatus according to claim 1, wherein at least one of the one or more reconstructed metadata signals comprises position information on one of the one or more audio object signals, or comprises a scaled representation of the position information on said one of the one or more audio object signals, and wherein the audio channel generator is configured to generate at least one of the one or more audio channels depending on said one of the one or more audio object signals and depending on said position information.

5. An apparatus according to claim 4, wherein at least one of the one or more reconstructed metadata signals comprises a volume of one of the one or more audio object signals, or comprises a scaled representation of the volume of said one of the one or more audio object signals, and wherein the audio channel generator is configured to generate at least one of the one or more audio channels depending on said one of the one or more audio object signals and depending on said volume.

6. An apparatus according to claim 1, wherein the apparatus is configured to receive random access information, wherein, for each compressed metadata signal of the one or more compressed metadata signals, the random access information indicates an accessed signal portion of said compressed metadata signal, wherein at least one other signal portion of said metadata signal is not indicated by said random access information, and wherein the metadata decoder is configured to generate one of the one or more reconstructed metadata signals depending on the first metadata samples of said accessed signal portion of said compressed metadata signal, but not depending on any other first metadata samples of any other signal portion of said compressed metadata signal.

7. An apparatus for decoding encoded audio data, comprising:

an input interface for receiving the encoded audio data, the encoded audio data comprising a plurality of encoded channels or compress metadata related to the plurality of objects, and an apparatus according to claim 1, wherein the metadata decoder of the apparatus according to claim 1 is a metadata decompressor for decompressing the compressed metadata, wherein the audio channel generator of the apparatus according to claim 1 comprises a core decoder for decoding the plurality of encoded channels, wherein the audio channel generator further comprises an object processor for processing the plurality of decoded objects using the decompressed metadata to acquire a number of output channels comprising audio data, and wherein the audio channel generator further comprises a post processor for converting the number of output channels into an output format.

8. An apparatus for generating encoded audio information comprising one or more encoded audio signals and one or more compressed metadata signals, wherein the apparatus comprises:

a metadata encoder for receiving one or more original metadata signals, wherein each of the one or more original metadata signals comprises a plurality of metadata samples, wherein the metadata encoder is configured to generate the one or more compressed metadata signals, so that each compressed metadata signal of the one or more compressed metadata signals comprises a first group of two or more of the metadata samples of an original metadata signal of the one or more original metadata signals, said compressed metadata signal being associated with said original metadata signal, and so that said compressed metadata signal does not comprise any metadata sample of a second group of another two or more of the metadata samples of said one of the original metadata signals, and an audio encoder for encoding one or more audio object signals to acquire the one or more encoded audio signals, wherein each of the metadata samples, that is comprised by an original metadata signal of the one or more original metadata signals and that is also comprised by the compressed metadata signal, which is associated with said original metadata signal, is one of a plurality of first metadata samples, wherein each of the metadata samples, that is comprised by an original metadata signal of the one or more original metadata signals and that is not comprised by the compressed metadata signal, which is associated with said original metadata signal, is one of a plurality of second metadata samples, wherein the metadata encoder is configured to generate an approximated metadata sample for each of a plurality of the second metadata samples of one of the original metadata signals by conducting a linear interpolation depending on at least two of the first metadata samples of said one of the one or more original metadata signals, and wherein the metadata encoder is configured to generate a difference value for each second metadata sample of said plurality of the second metadata samples of said one of the one or more original metadata signals, so that said difference value indicates a difference between said second metadata sample and the approximated metadata sample of said second metadata sample.

9. An apparatus according to claim 8, wherein the metadata encoder is configured to determine for at least one of the difference values of said plurality of the second metadata samples of said one of the one or more original metadata signals, whether each of the at least one of said difference values is greater than a threshold value.

10. An apparatus according to claim 8, wherein the metadata encoder is configured to encode one or more of the metadata samples of one of the one or more compressed metadata signals with a first number of bits, wherein each of said one or more of the metadata samples of said one of the one or more compressed metadata signals indicates an integer, wherein the metadata encoder is configured to encode one or more of the difference values of said plurality of the second metadata samples with a second number of bits, wherein each of said one or more of the difference values of said plurality of the second metadata samples indicates an integer, and wherein the second number of bits is smaller than the first number of bits.

11. An apparatus according to claim 8, wherein at least one of the one or more original metadata signals comprises position information on one of the one or more audio object signals, or comprises a scaled representation of the position information on said one of the one or more audio object signals, and wherein the metadata encoder is configured to generate at least one of the one or more compressed metadata signals depending on said at least one of the one or more original metadata signals.

12. An apparatus according to claim 11, wherein at least one of the one or more original metadata signals comprises a volume of one of the one or more audio object signals, or comprises a scaled representation of the volume of said one of the one or more audio object signals, and wherein the metadata encoder is configured to generate at least one of the one or more compressed metadata signals depending on said at least one of the one or more original metadata signals.

13. An apparatus for encoding audio input data to acquire audio output data, comprising:

an input interface for receiving a plurality of audio channels, a plurality of audio objects and metadata related to one or more of the plurality of audio objects, a mixer for mixing the plurality of objects and the plurality of channels to acquire a plurality of pre-mixed channels, each pre-mixed channel comprising audio data of a channel and audio data of at least one object, and an apparatus according to claim 8, wherein the audio encoder of the apparatus according to claim 7 is a core encoder for core encoding core encoder input data, and wherein the metadata encoder of the apparatus according to claim 7 is a metadata compressor for compressing the metadata related to the one or more of the plurality of audio objects.

14. A system, comprising:

an apparatus for generating encoded audio information comprising one or more encoded audio signals and one or more compressed metadata signals, and an apparatus according to claim 1 for receiving the one or more encoded audio signals and the one or more compressed metadata signals, and for generating one or more audio channels depending on the one or more encoded audio signals and depending on the one or more compressed metadata signals, wherein the apparatus for generating the encoded audio information comprises:

a metadata encoder for receiving one or more original metadata signals, wherein each of the one or more original metadata signals comprises a plurality of metadata samples, wherein the metadata encoder is configured to generate the one or more compressed metadata signals, so that each compressed metadata signal of the one or more compressed metadata signals comprises a first group of two or more of the metadata samples of an original metadata signal of the one or more original metadata signals, said compressed metadata signal being associated with said original metadata signal, and so that said compressed metadata signal does not comprise any metadata sample of a second group of another two or more of the metadata samples of said one of the original metadata signals, and an audio encoder for generating the one or more encoded audio signals, wherein each of the metadata samples, that is comprised by an original metadata signal of the one or more original metadata signals and that is also comprised by the compressed metadata signal, which is associated with said original metadata signal, is one of a plurality of first metadata samples, wherein each of the metadata samples, that is comprised by an original metadata signal of the one or more original metadata signals and that is not comprised by the compressed metadata signal, which is associated with said original metadata signal, is one of a plurality of second metadata samples, wherein the metadata encoder is configured to generate an approximated metadata sample for each of a plurality of the second metadata samples of one of the original metadata signals by conducting a linear interpolation depending on at least two of the first metadata samples of said one of the one or more original metadata signals, and wherein the metadata encoder is configured to generate a difference value for each second metadata sample of said plurality of the second metadata samples of said one of the one or more original metadata signals, so that said difference value indicates a difference between said second metadata sample and the approximated metadata sample of said second metadata sample.

15. A method for generating one or more audio channels, wherein the method comprises:

receiving one or more compressed metadata signals, wherein each of the one or more compressed metadata signals comprises a plurality of first metadata samples, generating one or more reconstructed metadata signals, so that each reconstructed metadata signal of the one or more reconstructed metadata signals comprises the first metadata samples of a compressed metadata signal of the one or more compressed metadata signals, said reconstructed metadata signal being associated with said compressed metadata signal, and further comprises a plurality of second metadata samples, wherein generating the one or more reconstructed metadata signals comprises generating the second metadata samples of each of the one or more reconstructed metadata signals by generating a plurality of approximated metadata samples for said reconstructed metadata signal, wherein generating each of the plurality of approximated metadata samples is conducted depending on at least two of the first metadata samples of said reconstructed metadata signal, and generating the one or more audio channels depending on one or more audio object signals and depending on the one or more reconstructed metadata signals, wherein the method further comprises receiving a plurality of difference values for a compressed metadata signal of the one or more compressed metadata signals, and adding each of the plurality of difference values to one of the approximated metadata samples of the reconstructed metadata signal being associated with said compressed metadata signal to acquire the second metadata samples of said reconstructed metadata signal.

16. A method for generating encoded audio information comprising one or more encoded audio signals and one or more compressed metadata signals, wherein the method comprises:

receiving one or more original metadata signals, wherein each of the one or more original metadata signals comprises a plurality of metadata samples, generating the one or more compressed metadata signals, so that each compressed metadata signal of the one or more compressed metadata signals comprises a first group of two or more of the metadata samples of an original metadata signal of the one or more original metadata signals, said compressed metadata signal being associated with said original metadata signal, and so that said compressed metadata signal does not comprise any metadata sample of a second group of another two or more of the metadata samples of said one of the original metadata signals, and encoding one or more audio object signals to acquire the one or more encoded audio signals, wherein each of the metadata samples, that is comprised by an original metadata signal of the one or more original metadata signals and that is also comprised by the compressed metadata signal, which is associated with said original metadata signal, is one of a plurality of first metadata samples, wherein each of the metadata samples, that is comprised by an original metadata signal of the one or more original metadata signals and that is not comprised by the compressed metadata signal, which is associated with said original metadata signal, is one of a plurality of second metadata samples, wherein the method further comprises generating an approximated metadata sample for each of a plurality of the second metadata samples of one of the original metadata signals by conducting a linear interpolation depending on at least two of the first metadata samples of said one of the one or more original metadata signals, and wherein the method further comprises generating a difference value for each second metadata sample of said plurality of the second metadata samples of said one of the one or more original metadata signals, so that said difference value indicates a difference between said second metadata sample and the approximated metadata sample of said second metadata sample.

17. Non-transitory digital storage medium having computer-readable code stored thereon to perform the method of claim 15 when being executed on a computer or signal processor.

18. Non-transitory digital storage medium having computer-readable code stored thereon to perform the method of claim 16 when being executed on a computer or signal processor.

* * * * *